US006174151B1

(12) United States Patent
Yarr

(10) Patent No.: US 6,174,151 B1
(45) Date of Patent: Jan. 16, 2001

(54) FLUID ENERGY TRANSFER DEVICE

(75) Inventor: George A. Yarr, Ballston Spa, NY (US)

(73) Assignee: The Ohio State University Research Foundation, Columbus, OH (US)

( * ) Notice: Under 35 U.S.C. 154(b), the term of this patent shall be extended for 0 days.

(21) Appl. No.: 09/193,491

(22) Filed: Nov. 17, 1998

(51) Int. Cl.[7] ..... F04C 2/00

(52) U.S. Cl. ..... 418/171; 418/166; 418/9; 418/61.3; 418/14; 417/310; 417/420; 137/469

(58) Field of Search ..... 418/171, 166, 418/14, 9, 61.3, 12; 417/420, 310, 228; 137/469

(56) References Cited

U.S. PATENT DOCUMENTS

| | | | | |
|---|---|---|---|---|
| 2,753,810 | * | 7/1956 | Quintilian | 418/166 |
| 3,680,989 | | 8/1972 | Brundage . | |
| 3,750,393 | | 8/1973 | Minto et al. . | |
| 3,824,044 | * | 7/1974 | Hinckley | 418/12 |
| 3,905,727 | | 9/1975 | Kilmer . | |
| 3,910,732 | | 10/1975 | Lusztig . | |
| 4,044,562 | | 8/1977 | England . | |
| 4,181,479 | | 1/1980 | Ross . | |
| 4,253,807 | | 3/1981 | Phal . | |
| 4,457,677 | | 7/1984 | Todd . | |
| 4,480,972 | | 11/1984 | Zumbusch . | |
| 4,484,870 | | 11/1984 | Erasov . | |
| 4,492,539 | | 1/1985 | Specht . | |
| 4,519,755 | * | 5/1985 | Hanson | 418/9 |
| 4,526,518 | | 7/1985 | Wiernicki . | |
| 4,533,302 | | 8/1985 | Begley . | |
| 4,545,748 | | 10/1985 | Middlekauff . | |
| 4,557,112 | | 12/1985 | Smith . | |
| 4,569,644 | | 2/1986 | Swedberg . | |
| 4,586,875 | * | 5/1986 | Aman, Jr. | 417/228 |
| 4,747,744 | * | 5/1988 | Dominique et al. | 417/420 |
| 4,881,880 | | 11/1989 | Dlugokecki . | |
| 4,894,994 | | 1/1990 | Carter . | |
| 4,940,401 | | 7/1990 | White, Jr. . | |
| 5,017,101 | | 5/1991 | White . | |
| 5,062,776 | * | 11/1991 | Dlugokecki | 418/61.3 |
| 5,114,324 | | 5/1992 | Spindeldreher . | |
| 5,165,238 | | 11/1992 | Paul et al. . | |
| 5,195,882 | * | 3/1993 | Freeman | 418/171 |
| 5,328,343 | | 7/1994 | Bernstrom et al. . | |
| 5,410,998 | | 5/1995 | Paul et al. . | |
| 5,439,357 | | 8/1995 | Barthod et al. . | |
| 5,472,329 | | 12/1995 | Maynard et al. . | |
| 5,569,024 | * | 10/1996 | Dummersdorf et al. | 417/420 |
| 5,711,660 | | 1/1998 | Mitarai et al. . | |
| 5,722,815 | | 3/1998 | Cozens . | |
| 5,762,101 | * | 6/1998 | Burke et al. | 137/469 |

FOREIGN PATENT DOCUMENTS

410331777 * 12/1998 (JP) .

* cited by examiner

*Primary Examiner*—Thomas Denion
*Assistant Examiner*—Thai-Ba Trieu
(74) *Attorney, Agent, or Firm*—Philip J. Pollick

(57) ABSTRACT

A trochoidal gear pump or engine uses a coaxial hub with the outer and/or inner rotor and an associated rolling element bearing assembly that preferably uses pre-loaded bearings to precisely set the rotational axis and/or the axial position of the rotor with which it is associated. This allows the fixed-gap clearance between the rotor surfaces and the housing surfaces or the other rotor surfaces to be set at a distance that minimizes operating fluid shear forces and/or by-pass leakage and eliminates gear tooth wear thus preserving effective chamber to chamber sealing. The device is useful in handling gaseous and two-phase fluids in expansion/contracting fluid engines/compressors and can incorporate an output shaft that accommodates an integrated condensate pump for use with Rankine cycles. A vent from the housing cavity to a lower pressure input or output port regulates built-up fluid pressure in the housing thereby optimizing the efficiency of the device by controlling bypass leakage.

254 Claims, 10 Drawing Sheets

FLUID ENERGY TRANSFER DEVICE

BACKGROUND OF THE INVENTION

1. Field of the Invention

The present invention relates to energy transfer devices that operate on the principal of intermeshing trochoidal gear fluid displacement and more particularly to the reduction of frictional forces in such systems.

2. Background

Trochoidal gear, fluid displacement pumps and engines are well-known in the art. In general, a lobate, eccentrically-mounted, inner male rotor interacts with a mating lobate female outer rotor in a close-fitting chamber formed in a housing with a cylindrical bore and two end plates. The eccentrically mounted inner rotor gear has a set number of lobes or teeth and cooperates with a surrounding outer lobate rotor, i.e., ring gear, with one additional lobe or tooth than the inner rotor. The outer rotor gear is contained within the close fitting cylindrical enclosure.

The inner rotor is typically secured to a drive shaft and, as it rotates on the drive shaft, it advances one tooth space per revolution relative to the outer rotor. The outer rotor is rotatably retained in a housing, eccentric to the inner rotor, and meshing with the inner rotor on one side. As the inner and outer rotors turn from their meshing point, the space between the teeth of the inner and outer rotors gradually increases in size through the first one hundred eighty degrees of rotation of the inner rotor creating an expanding space. During the last half of the revolution of the inner rotor, the space between the inner and outer rotors decreases in size as the teeth mesh.

When the device is operating as a pump, fluid to be pumped is drawn from an inlet port into the expanding space as a result of the vacuum created in the space as a result of its expansion. After reaching a point of maximum volume, the space between the inner and outer rotors begins to decrease in volume. After sufficient pressure is achieved due to the decreasing volume, the decreasing space is opened to an outlet port and the fluid forced from the device. The inlet and outlet ports are isolated from each other by the housing and the inner and outer rotors.

One significant problem with such devices are efficiency losses and part wear due to friction between the various moving parts of the configuration. Such loss of efficiency can be especially severe when the device is used as an engine or motor rather than a pump.

To eliminate frictional losses, various inventors such as Lusztig (U.S. Pat. No. 3,910,732), Kilmer (U.S. Pat. No. 3,905,727) and Specht (U.S. Pat. No. 4,492,539) have used rolling element bearings. However, such bearings have been used mainly to control frictional losses between the drive shaft and the device housing rather than the internal mechanism of the device itself.

Minto et al (U.S. Pat. No. 3,750,393) uses the device as an engine (prime mover) by providing high pressure vapor to the chambers which causes their expansion and associated rotation of the inner rotor shaft. On reaching maximum expansion of the chamber, an exhaust port carries away the expanded vapor. Minto recognizes that binding between the outer radial surface of the rotating outer gear and the close-fitting cylindrical enclosure due to differences in pressure between the inner and outer faces of the outer rotor element is a problem. To obviate the effect of the unbalanced radial hydraulic forces on the outer rotor, Minto proposes the use of radial passages in one of the end plates that extend radially outward from the inlet and outlet ports to the inner cylindrical surface of the cylindrical enclosure. These radial passages then communicate with a longitudinal groove formed in the inner surface of the cylindrical enclosure.

In order to improve efficiency through friction and wear reduction when the device is used as a pump, Dominique et al (U.S. Pat. No. 4,747,744) has made modifications to the device that reduce or minimize the frictional forces. However, Dominique also realizes that one of the problems with this type of device is by-pass leakage between the inlet and outlet ports of the device. That is, the operating fluid flows directly from the input to the output ports without entering the expanding and contracting chambers of the device. To reduce bypass leakage, Dominique forces the inner and outer rotors of the device into close contact with the end plate containing the inlet and outlet ports using a number of mechanisms including springs, pressurized fluids, magnetic fields, or spherical protrusions. Unfortunately this can lead to contact of the rotors with the end plate and attendant high frictional losses and loss of efficiency. Although such losses are not a major design factor when the device is used as a pump, it is of major concern when using the device as an engine and a motor. Here such frictional losses can be a major detriment to the efficiency of the engine.

In addition to frictional losses, the basic design of the device causes wear of the gear profiles, especially at the gear lobe crowns resulting in a degradation in chamber to chamber sealing ability. For good chamber to chamber sealing, a typical gear profile clearance is of the order of 0.002 inch (0.05 mm). To provide a hydrodynamic journal bearing between the outer radial surface of the outer rotor and the inner radial surface of the containment housing, a corresponding clearance of about 0.005–0.008 inch (0.13–0.20 mm) is needed. During running, small eccentricities of the outer rotor axis cause contact of the crowns of the inner and outer rotor lobes as they pass by each other resulting in wear of the gear lobe crowns and degradation of the chamber to chamber sealing ability.

Thus it is an object of this invention to provide a trochoidal gear device of high mechanical efficiency.

It is a further object of this invention to provide a trochoidal gear device with minimum friction losses.

It is an object of this invention to provide a trochoidal gear device with minimum mechanical friction losses.

It is a further object of this invention to provide a trochoidal gear device with minimum fluidic frictional losses.

It is another object of this invention to provide a mechanically simple energy conversion device.

It is an object of this invention to set precisely the gaps between moving surfaces of the device.

It is an object of this invention to provide a low-cost energy conversion device.

It is an object of this invention to provide a direct-coupled alternator/motor device in a hermetically sealed unit.

It is yet another object of this invention to provide a device that avoids degradation of its components.

It is a further object of this invention to provide a device with an integrated condensate pump for condensed fluid cycles such as Rankine cycles.

It is an object of this invention to provide a device for handling fluids that condense on expansion or contraction.

It is an object of this invention to provide a device that eliminates wear of rotor gear profiles.

Another object of this invention is to maintain high chamber to chamber sealing ability.

SUMMARY OF THE INVENTION

To meet these objects, the present invention is directed to a rotary, chambered, fluid energy-transfer device of the class referred to as trochoidal gear pumps and engines of which the gerotor is a species. The device is contained in a housing having a cylindrical portion with a large bore formed therein. A circular end plate is attached to the cylindrical portion and has a fluid inlet passage and a fluid outlet passage. An outer rotor rotates within the large bore of the cylindrical housing portion. The outer rotor has a bore formed in it leaving a radial portion with an outer radial edge facing the interior radial surface of the bore in the housing cylinder. A female gear profile is formed in the interior bore of the outer rotor. An end covers the bore and female gear profile of the outer rotor. A second end face opposite the covering end skirts the female gear profile. An inner rotor is contained within the interior bore of the outer rotor and has a male gear profile that is in operative engagement with the female gear profile of the outer rotor. The male gear profile of the inner rotor has one less tooth than the outer gear profile and an axis that is eccentric with the axis of the outer rotor gear profile.

The present invention features a coaxial hub that extends normally from the end that covers the outer rotor or from a face of the inner rotor. The hub portion may be formed as an integral part of the inner or outer rotor or as a separate shaft typically in force fit engagement with the inner or outer rotor. In one of the preferred embodiments, a coaxial hub extends from both the end plate of the outer rotor and a face of the inner rotor. The hub on either rotor has a shaft portion that is mounted in the housing with a rolling element bearing assembly. The rolling element bearing assembly has at least one rolling element bearing with the assembly being used to set the rotational axis or the axial position of the rotor with which it is associated. Preferably both the rotational axis and the axial position of the rotor are set with the bearing assembly. Various types of rolling element bearings can be used with the bearing assembly including thrust bearings, radial load ball bearings, and tapered rolling element bearings. Preferably a pair of pre-loaded, rolling element bearings, e.g., angular-contact or deep groove ball bearings, are used to set both the rotational axis and the axial position of the associated rotor.

The feature of precisely setting the rotational axis or axial position of a particular rotor with a bearing assembly has the advantage of maintaining a fixed-gap clearance of the associated rotor with at least one surface of the housing or the other rotor. Depending on its location, the fixed-gap clearance between the rotor surface and the housing surface or the other rotor surface is set at a distance that is 1) greater than the boundary layer of the operating fluid used in the device in order to minimize operating fluid shear forces or 2) at a distance that is optimal for a) minimizing by-pass leakage i) between chambers formed by the engagement of the female and male gear profiles, ii) between these chambers and the inlet and outlet passages, and iii) between the inlet and outlet passages and also b) for minimizing operating fluid shear forces. In one preferred embodiment, both rotors have hubs that are mounted with bearing assemblies in the housing in order to control all interface surfaces between each rotor and its opposing housing surface or between the interface surfaces of two opposing rotor surfaces. This has the advantage of keeping frictional loses in the device to a minimum and allowing the device to function as a very efficient expansion engine or fluid compressor.

In a configuration that features a rolling element bearing assembly to fix the axial position or rotational axis or both of the outer rotor, the inner rotor has a bored central portion that allows for rotation about a hub that extends from the end plate. Fixing of the rotational axis of the outer rotor with a bearing assembly has the advantage of eliminating the need to provide pressure equalizing grooves between the chambers to prevent unbalanced radial hydraulic forces that result in contact of the outer radial surface of the outer rotor with the cylindrical housing and attendant frictional loss and even seizing of the rotor and housing. Another feature of this embodiment is the use of a rolling element bearing positioned between the end plate hub and the inner surface of the central bore portion of the inner rotor which has the advantage of reducing substantially the frictional losses from the rotation of the inner rotor about the end plate hub. This configuration also features the use of a bearing assembly, e.g., a thrust bearing such as a needle thrust bearing, to maintain a minimum fixed-gap clearance between the inner face of the end plate and the end face of the inner rotor. This has the further advantage of eliminating contact between the inner rotor end face and the end plate and setting the minimum fixed-gap clearance that is maintained between the two surfaces. At operating pressures, hydraulic forces urge the inner rotor to the minimum fixed-gap clearance position thereby also maintaining a fixed-gap clearance between the opposite face of the inner rotor and the inner face of the closed end of the outer rotor.

The present invention maintains superior chamber to chamber sealing ability over long periods of use. In prior art devices, gear lobe crown wear occurs as a result of the need to use a small gear profile clearance between the inner and outer rotor gear profiles, e.g., 0.002 inch, in order to maintain chamber to chamber sealing ability while the required clearance between the outer rotor and housing needs to be several times larger, e.g., 0.005–0.008 inch, in order to form a hydrodynamic journal bearing. During running, small eccentricities of the outer rotor axis cause contact of the lobe crowns of the inner and outer rotors resulting in lobe wear and degradation of the chamber to chamber sealing ability. The feature of using rolling element bearings to set and maintain the axes of both rotors to within a few ten-thousandths of an inch and even less when pre-loaded are used has the advantage of eliminating shear on the lobe crowns and maintaining superior chamber to chamber sealing ability over the life of the device.

The present invention is especially useful in handling two-phase fluids in expansion engines and contracting fluid devices (compressors). When operating as an engine, the device features an output shaft that has the advantage of accommodating an integrated condensate pump with the further advantages of eliminating pump shaft seals and attendant seal fluid losses and matching pump and engine capacity in Rankine cycles where the fluid mass flow rate is the same through both the engine and condensate pump.

The invention also features a vent conduit from the housing cavity to a lower pressure input or output port which has the advantage of controlling built-up fluid pressure in the internal housing cavity thereby reducing fluid shear forces and also of alleviating strain on the housing structure especially when used as a hermitically sealed unit with magnetic drive coupling. The invention also features a pressure regulating valve, such as a throttle valve (automatic or manual), to control operating fluid pressure in the housing cavity. By controlling and maintaining a positive pressure in the housing cavity, bypass leakage at the interface between the outer rotor and the end plate and excessive pressure build up with attendant large fluid shear force energy losses and housing structural strain are substantially reduced.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
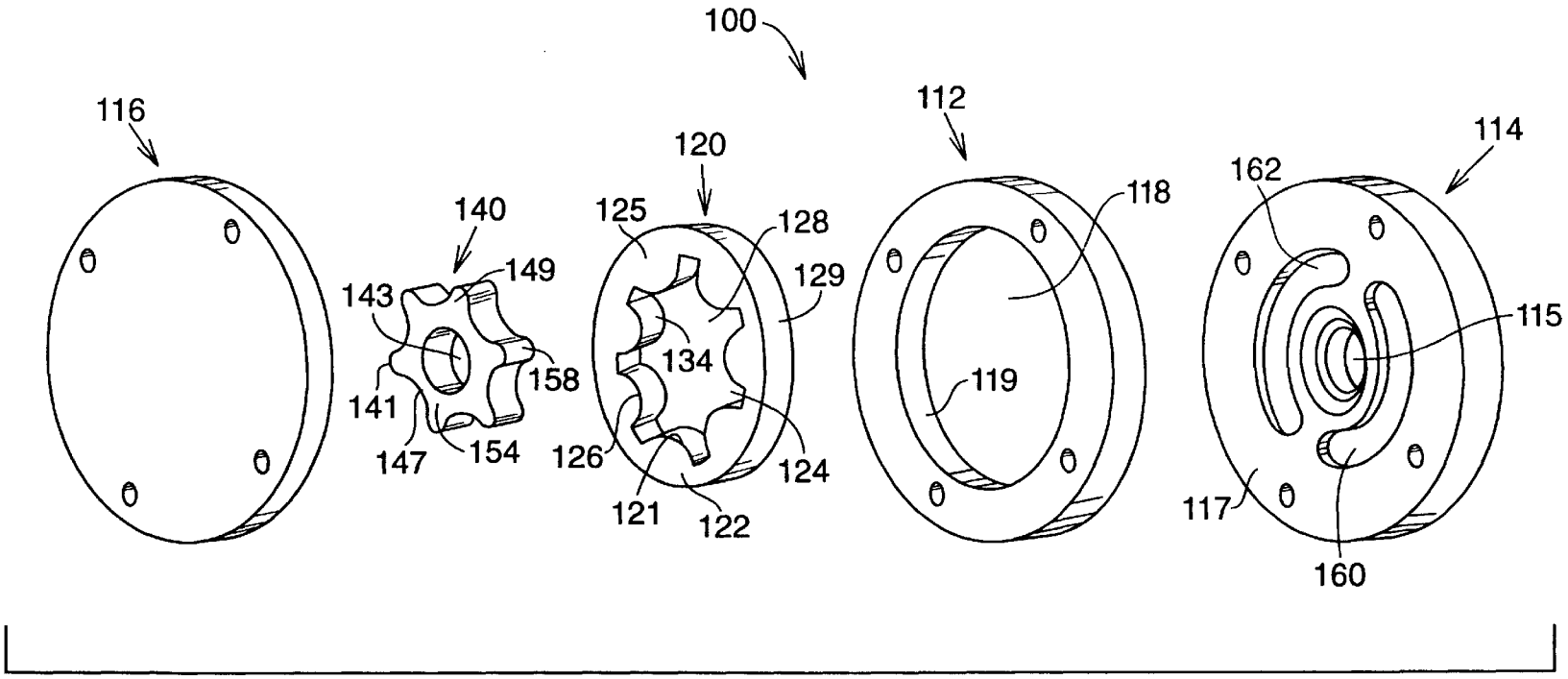
PRIOR ART Fig. 1
FIG. 1 is an exploded perspective view of a conventional trochoidal gear device.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

Figure 3:
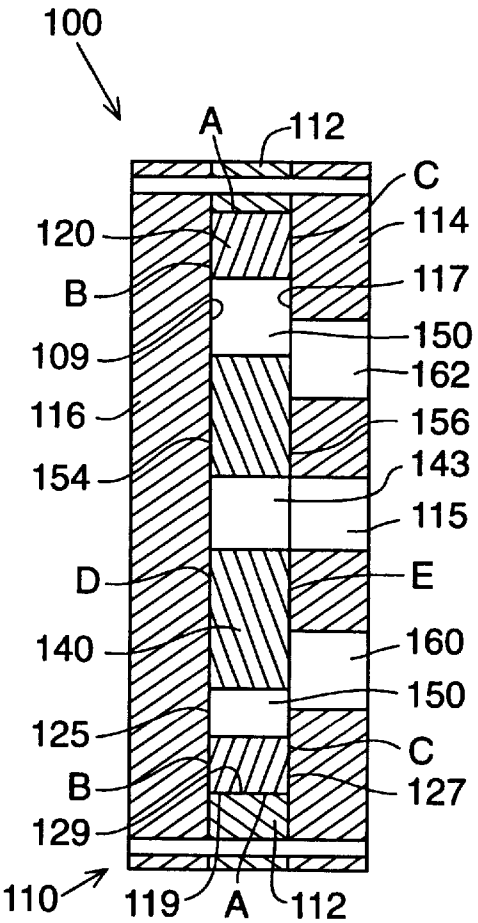
PRIOR ART Fig. 3
FIG. 3 is a cross-sectional view of a conventional trochoidal gear device taken along a diameter of the cylindrical housing.
Figure 2:
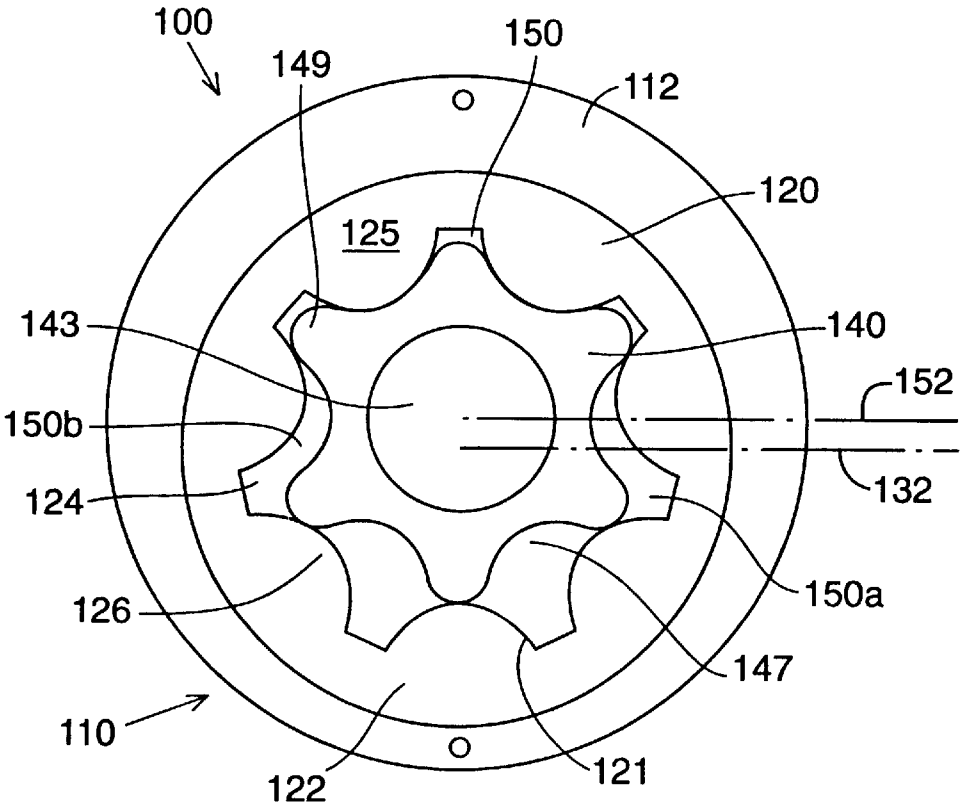
PRIOR ART Fig. 2
FIG. 2 is a sectional end view of a conventional trochoidal gear device with an end plate removed.

With reference to the drawings and initially FIGS. 1–3, a conventional trochoidal element, fluid displacement device (pump or engine) of which a species is a gerotor is generally denoted as device 100 and includes a housing 110 with a cylindrical portion 112 having a large axial cylindrical bore 118 typically closed at opposite ends in any suitable manner, such as by removable static end plates 114 and 116 to form a housing cavity substantially identical with cylindrical housing bore 118.

An outer rotor 120 freely and rotatably mates with the housing cavity (axial bore 118). That is, the outer peripheral surface 129 and opposite end faces (surfaces) 125 and 127 of outer rotor 120 are in substantially fluid-tight engagement with the inner end faces (surfaces) 109, 117 and peripheral radial inner surface 119 which define the housing cavity. The outer rotor element 120 is of known construction and includes a radial portion 122 with an axial bore 128 provided with a female gear profile 121 with regularly and circumferentially spaced longitudinal grooves 124, illustrated as seven in number, it being understood that this number may be varied, the grooves 124 being separated by longitudinal ridges 126 of curved transverse cross section.

Registering with the female gear profile 121 of outer rotor 120 is an inner rotor 140 with male gear profile 141 rotatable about rotational axis 152 parallel and eccentric to rotational axis 132 of outer rotor 120 and in operative engagement with outer rotor 120. Inner rotor 140 has end faces 154,156 in fluid-tight sliding engagement with the end faces 109,117 of end plates 116,114 of housing 110 and is provided with an axial shaft (not shown) in bore 143 projecting through bore 115 of housing end plate 114. Inner rotor 140, like outer rotor 120, is of known construction and includes a plurality of longitudinally extending ridges or lobes 149 of curved transverse cross section separated by curved longitudinal valleys 147, the number of lobes 149 being one less than the number of outer rotor grooves 124. The confronting peripheral edges 158,134 of the inner and outer rotors 140 and 120 are so shaped that each of the lobes 149 of inner rotor 140 is in fluid-tight linear longitudinal slideable or rolling engagement with the confronting inner peripheral edge 134 of the outer rotor 120 during full rotation of inner rotor 140.

A plurality of successive advancing chambers 150 are delineated by the housing end plates 114,116 and the confronting edges 158,134 of the inner and outer rotors 140, 120 and separated by successive lobes 149. When a chamber 150 is in its topmost position as viewed in FIG. 2, it is in its fully contracted position and, as it advances either clockwise or counterclockwise, it expands until it reaches an 180° opposite and fully expanded position after which it contracts with further advance to its initial contracted position. It is noted that the inner rotor 140 advances one lobe relative to the outer rotor 120 during each revolution by reason of there being one fewer lobes 149 than grooves 124.

Port 160 is formed in end plate 114 and communicates with expanding chambers 150*a*. Also formed in end plate 114 is port 162 reached by forwardly advancing chambers 150 after reaching their fully expanded condition, i,e., contracting chambers 150*b*. It is to be understood that chambers 150*a* and 150*b* may be expanding or contracting relative to ports 160,162 depending on the clockwise or counterclockwise direction of rotation of the rotors 120,140.

When operating as a pump or compressor, a motive force is applied to the inner rotor 140 by means of a suitable drive shaft mounted in bore 143. Fluid is drawn into the device through a port, e.g., 160 by the vacuum created in expanding chambers 150*a* and after reaching maximum expansion, contracting chambers 150*b* produce pressure on the fluid which is forced out under pressure from the contracting chambers 150*b* into the appropriate port 162.

When operating as an engine, a pressurized fluid is admitted through a port, e.g., 160, which causes an associated shaft to rotate as the expanding fluid causes chamber 150 to expand to its maximum size after which the fluid is exhausted through the opposite port as chamber 150 contracts.

In the past, it has been customary to mount rotors 120 and 140 in close clearance with the housing 110. Thus the outer radial edge 129 of outer rotor 120 is in close clearance with the interior radial surface 119 of cylindrical housing portion 112 while the ends (faces) 125,127 of outer rotor 120 are in close clearance with the inner faces 117,109 of end plates 114 and 116. The radial close tolerance interface between the radial edge 129 of outer rotor 120 and inner radial housing surface 119 is designated as interface A while the close tolerance interfaces between the ends 125, 127 of outer rotor 120 and faces 109, 117 of end plates 114 and 116 are designated as interfaces B and C. Similarly the close tolerance interfaces between the faces 154, 156 of inner rotor 140 and faces 109, 117 of end plates 114, 116 are designated as interfaces D and E. The close radial tolerance of interface A necessary to define the rotational axis of rotor 120 and the close end tolerances of interfaces B, C, D, and E required for fluid sealing in chambers 150 induce large fluid shear losses that are proportional to the speed of the rotors 120 and 140. In addition, unbalanced hydraulic forces on the faces 125, 127,154,156 of the rotors 120 and 140 can result in intimate contact of the rotor faces 125, 127, 154, 156 and the inner faces 109, 117 of the static end plates 114,116 causing very large frictional losses and even seizure. Although shear losses can be tolerated when the device is operated as a pump, such losses can mean the difference between success and failure when the device is used as an engine.

Figure 4:
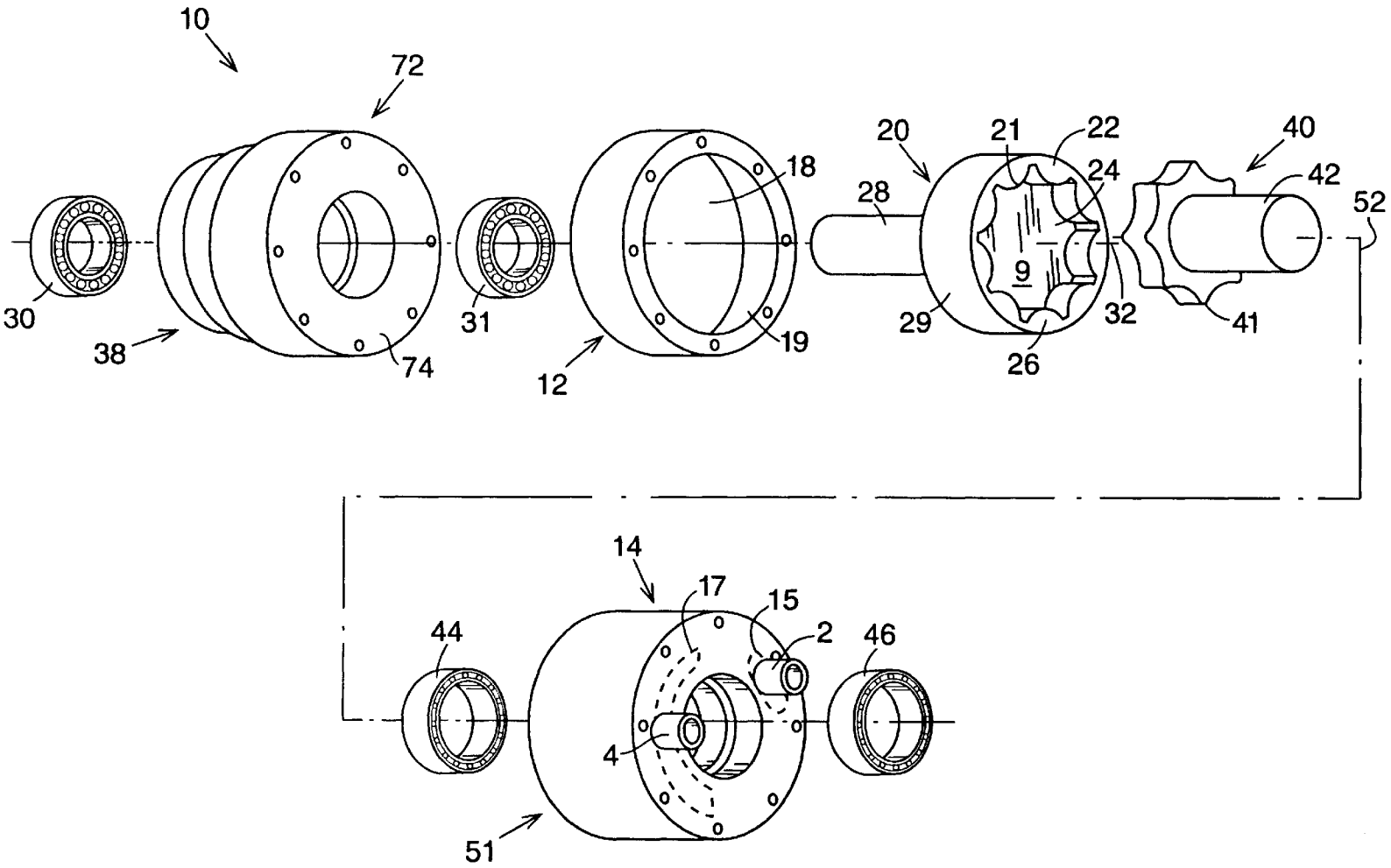
FIG. 4 is an exploded perspective view of the present invention illustrating the use of pre-loaded bearing assemblies with hubs on both the inner and outer rotors.

To overcome the large fluid shear and contact losses, the rotors have been modified to minimize these large fluid shear and contact losses. To this end, the rotary, chambered, fluid energy-transfer device of the present invention is shown in FIGS. 4–7 and designated generally as 10. Device 10 comprises a housing 11 having a cylindrical portion 12 with a large cylindrical bore 18 formed therein and a static end plate 14 having inlet and outlet passages designated as a first passage 15 and a second passage 17 (FIGS. 4 and 7), it being understood that the shape, size, location and function of the first passage 15 and second passage 17 will vary depending on the application for which the device is used. Thus when the device is used to pump liquids, the inlet and outlet (exhaust) ports encompass nearly 180° each of the expanding and contracting chamber arcs in order to prevent hydraulic lock or cavitation (FIG. 1, ports 160 and 162). However, when the device is used as an expansion engine or compressor, inlet and exhaust ports that are too close to each other can be the source of excessive bypass leakage loss. For compressible fluids such as employed when the device is used as an expansion or contraction machine (FIG. 7, ports 15 and 17), the separation between the inlet and exhaust ports 15 and 17 is much greater, thereby reducing leakage between the ports, the leakage being inversely proportional to the distance between the high and low pressure ports 15 and 17. For compressible fluids, the truncation of one of the ports, e.g., port 15, causes fluid to be trapped in the chambers 50 formed by the outer rotor 20 and inner rotor 40 with no communication to the ports 15 or 17 resulting in expansion or contraction of the fluid (depending on the direction of rotation of the rotors) promoting rotation of the rotors when the device is used as an expansion machine or work being applied to the rotors when the device is used as a compression machine. In addition, the length of the truncated port 15 determines the expansion or compression ratio of the device, that is, the expansion or compression ratio of device 10 can be changed by altering the circumferential length of the appropriate port. For an expansion engine, port 15 is the truncated inlet port with port 17 serving as the exhaust or outlet port. For a contraction device, the roles of ports 15 and 17 are reversed, that is, port 15 serves as the exhaust port while port 17 serves as the inlet port. When operating as a contracting or compression machine, the direction of rotation of rotors 20 and 40 is opposite to that shown in FIG. 7. Parts 15 and 17 communicate with conduits 2 and 4 (FIG. 4).

Figure 5:
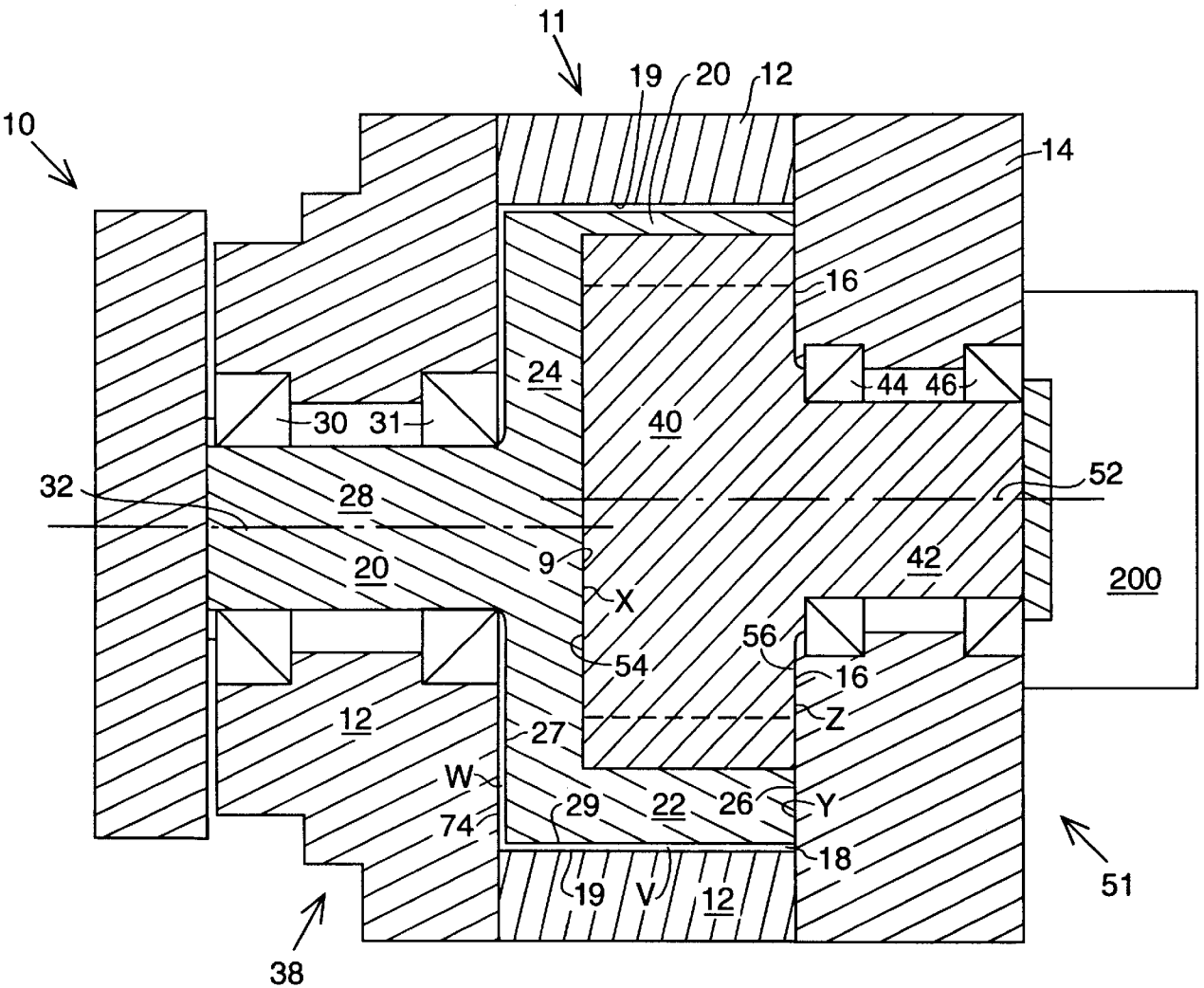
FIG. 5 is a cross sectional view of the present invention illustrating the use of pre-loaded bearing assemblies with hubs on both the inner and outer rotors with a schematic illustration of an integrated condensate pump assembly using the shaft of the inner rotor as a pump shaft.

To eliminate the fluid shear and other frictional energy losses at the interface between the outer rotor and one of the end plates (interface B between rotor 120 and end plate 116 in FIG. 3), the end plate and outer rotor can be formed as one piece or otherwise suitably attached as shown in FIGS. 4 and 5. That is, the outer rotor 20 comprises (1) a radial portion 22, (2) a female gear profile 21 formed in radial portion 22, (3) an end 24 that covers female gear profile 21 and rotates as part of rotor 20 and which may be formed as an integral part of the radial portion 22, and (4) a rotor end surface or end face 26 that skirts female gear profile 21.

An inner rotor 40, with a male gear profile 41, is positioned in operative engagement with outer rotor 20. Outer rotor 20 rotates about rotational axis 32 which is parallel and eccentric to rotational axis 52 of inner rotor 40.

By attaching end plate 24 to rotor 20 and making it a part thereof, it rotates with radial portion 22 containing female gear profile 21 and thereby completely eliminates the fluid shear losses that occur when rotor 20 rotates against a static end plate (interface B in FIG. 3). Further, since end face 54 of inner rotor 40 rotates against the rotating interior face 9 of end 24 of rotor 20 rather than against a static surface, the fluid shear losses at resulting interface X (FIGS. 5 and 6) are significantly reduced. Specifically, since the relative rotational speed between the inner rotor 40 and outer rotor 20 is 1/N times the outer rotor 20 speed, where N is the number of teeth on the outer rotor 20, the sliding velocity between the end face 54 of the inner rotor 40 and the rotating interior face 9 of end closure 24 on outer rotor 20 is proportionally reduced as compared to the usual mounting configuration shown in FIGS. 1–3. Hence for the same fluid and clearance conditions, the losses are 1/N as large. Additionally, because the rotating end closure plate 24 is attached to the outer rotor, bypass leakage from chambers 50 past the interface between the static end plate (interface B in FIG. 3) to the radial extremities of the device, e.g., the gap at interface V, is completely eliminated.

In addition to interface X, the interface between the rotating interior face 9 of end 24 of outer rotor 20 and the face 54 of inner rotor 40, five additional interfaces are the focus of the current invention. These include, 1)) interface V between the interior radial surface 19 of cylindrical housing portion 12 and the outer radial edge 29 of outer rotor 20, 2) interface W between end face 74 of housing element 72 and exterior face 27 of end 24 of rotor 20, 3) interface Y between end face 26 of rotor 20 and interior end face 16 of end plate 14, and 4) interface Z between face 56 of inner rotor 40 and interior end face 16 of end plate 14. Of lesser concern is interface U, the interface between the interior face 9 of end 24 of outer rotor 20 and face 8 of hub 7 of end plate 14. Because of the relatively low rotation velocities in the area of interior face 9 near its rotational axis 32, any clearance that prevents contact of the two surfaces is usually acceptable.

By maintaining a fixed-gap clearance between at least one of the surfaces of one of the rotors and the housing 11 or the other rotor, fluid shear and other frictional forces can be reduced significantly leading to a highly efficient device especially useful as an engine or prime mover. To maintain such a fixed-gap clearance, either the outer rotor 20 or the inner rotor 40 or both are formed with a coaxial hub (hub 28 on rotor 20 or hub 42 on rotor 40) with at least a portion of hub 28 or 42 is formed as a shaft for a rolling element bearing and mounted in housing 11 with a rolling element bearing assembly (38 or 51 or both) with the rolling element bearing assembly comprising a rolling element bearing such as ball bearings 30, 31, 44 or 46. The rolling element bearing assembly 38 or 51 or both sets establish: 1) the rotational axis 32 of outer rotor 20 or the rotational axis 52 of inner rotor 40, or 2) the axial position of outer rotor 20 or the axial position of the inner rotor 40, or 3) both the rotational axis and axial position of outer rotor 20 or inner rotor 40, or 4) both the rotational axis and axial position of both other rotor 20 and inner rotor 40. It is to be realized that the bearing assembly 38 or 51 includes elements that attach to or are a part of device housing 11. Thus in FIG. 5, bearing assembly 38 includes static bearing housing 72 which is also a part of housing 11. Similarly bearing assembly 51 includes static bearing housing 14 which also serves as the static end plate 14 of housing 11.

Referring to FIG. 5, it is seen that by setting the rotational axis of outer rotor 20 with hub 28 and bearing assembly 38, a fixed-gap clearance is maintained at interface V, the interface between radial inner surface 19 of cylindrical housing portion 12 and outer radial edge 29 or outer rotor 20. By setting the axial position of outer rotor 20 with bearing assembly 38, a fixed-gap clearance is maintained at interface W, the interface between face 74 of housing element 72 and exterior face 27 of end 24 of outer rotor 20 and interface Y, the interface between face 26 of rotor 20 and face 16 of static end plate 14. By setting the axial position of inner rotor 40 with hub 42 and bearing assembly 51, a fixed-gap clearance is maintained at interface Z, the interface between face 56 of inner rotor 40 and face 16 of end plate 14.

To set a fixed-gap clearance at interface X, both the axial position of outer rotor 20 and the axial position of inner rotor 40 must be fixed. As shown in FIG. 5, hub 28 and bearing assembly 38 are used to set the axial position of outer rotor 20 which in turn sets the axial position of the interior face 9 of end 24. Hub 42 and bearing assembly 51 set the axial position of inner rotor 40 which also sets the axial position of face 54. By setting the axial position of face 54 (rotor 40) and face 9 (rotor 20), a fixed-gap clearance at interface X is defined.

The fixed-gap clearances at interface V and W are set to reduce fluid shear forces as much as possible. Since frictional forces due to the viscosity of the fluid are restricted to the fluid boundary layer, it is preferable to maintain the fixed gap distance at as great a value as possible to avoid such forces. Preferably for the purposes of this invention, the boundary layer is taken as the distance from the surface where the velocity of the flow reaches 99 percent of a free stream velocity. As such, the fixed gap clearance at interface V and W depend on and is determined by the viscosity of the fluid used in the device and the velocity at which the rotor surfaces travel with respect to the surfaces of the static components. Given the viscosity and velocity parameters, the fixed gap clearances at interfaces V and W are preferably set at a value greater than the fluid boundary layer of the operating fluid used in the device.

For the fixed-gap clearances at interfaces X, Y and Z, consideration must be given to reducing both fluid shear forces and bypass leakage between 1) the expanding and contracting chambers 50 of the device, 2) the inlet and outlet passages 15 and 17 and 3) the expanding and contracting chambers 50 and the inlet and outlet passages 15 and 17. Since bypass leakage is proportional to clearance to the third power and shearing forces are inversely proportional to clearance, the fixed gap of these interfaces is set to a substantially optimal distance as a function of both bypass leakage and operating fluid shear losses, that is, sufficiently large to substantially reduce fluid shear losses but small enough to avoid significant bypass leakage. One may obtain the optimal operating clearance distance from a simultaneous solution of equations for the bypass leakage and fluid shearing force to yield an optimum clearance for a given set of operating conditions. For gases and liquid vapors, the bypass leakage losses dominate, especially at higher Pressures, hence the clearances are optimally set at the minimum practical mechanical clearance, e.g., roughly about 0.001 inches (0.025 mm) for a device with an outer rotor diameter of about 4 inches (0.1 m). For liquids, the simultaneous solution of the leakage and shear equations typically provide the optimal clearance. Mixed-phase fluids are not readily amenable to mathematical solution due to the gross physical property differences of the individual phases and thus are best determined empirically.

Figure 6:
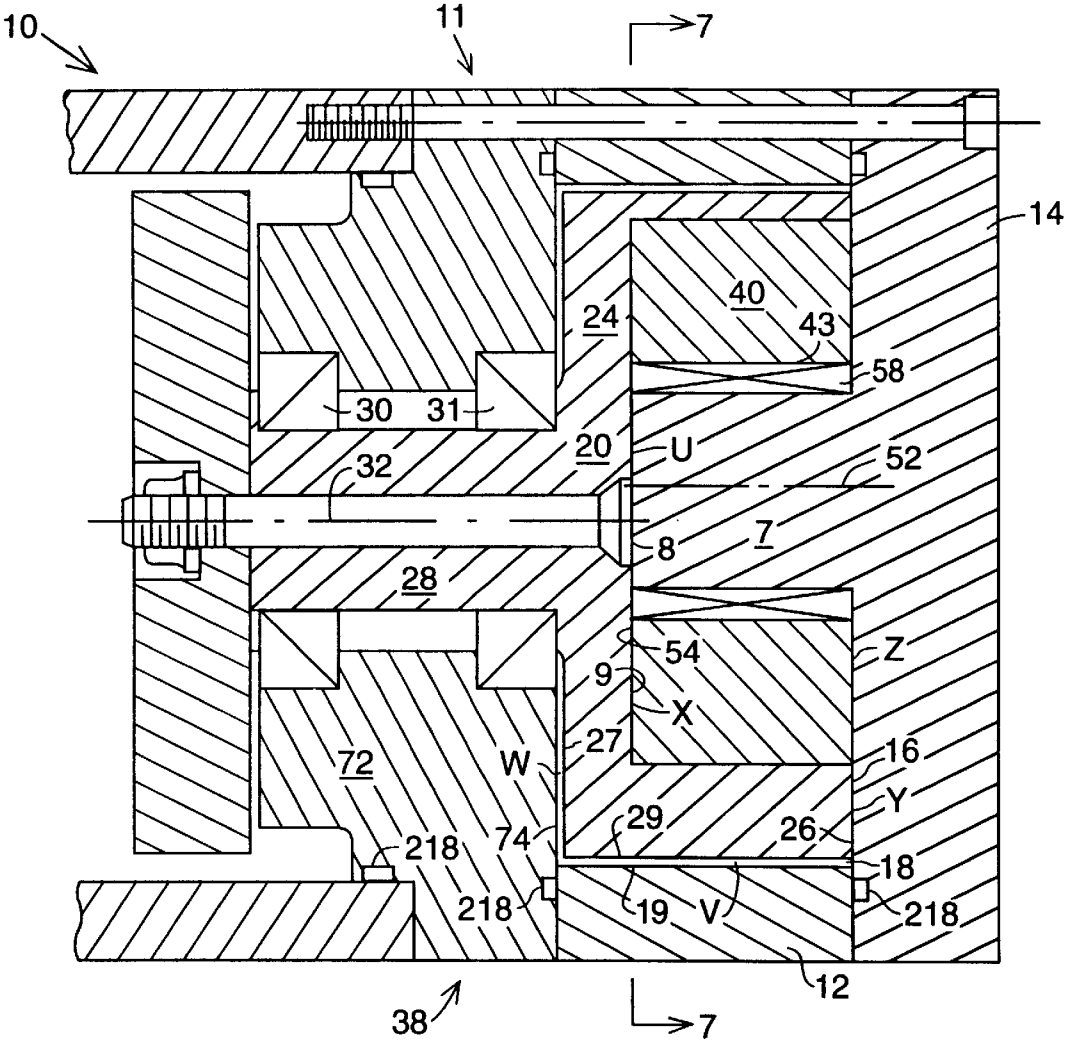
FIG. 6 is a cross-sectional view of the present invention illustrating the use of a pre-loaded bearing assembly with the hub on the outer rotor while the inner rotor is allowed to float on a hub and roller bearing assembling projecting from the housing end plate.
Figure 7:
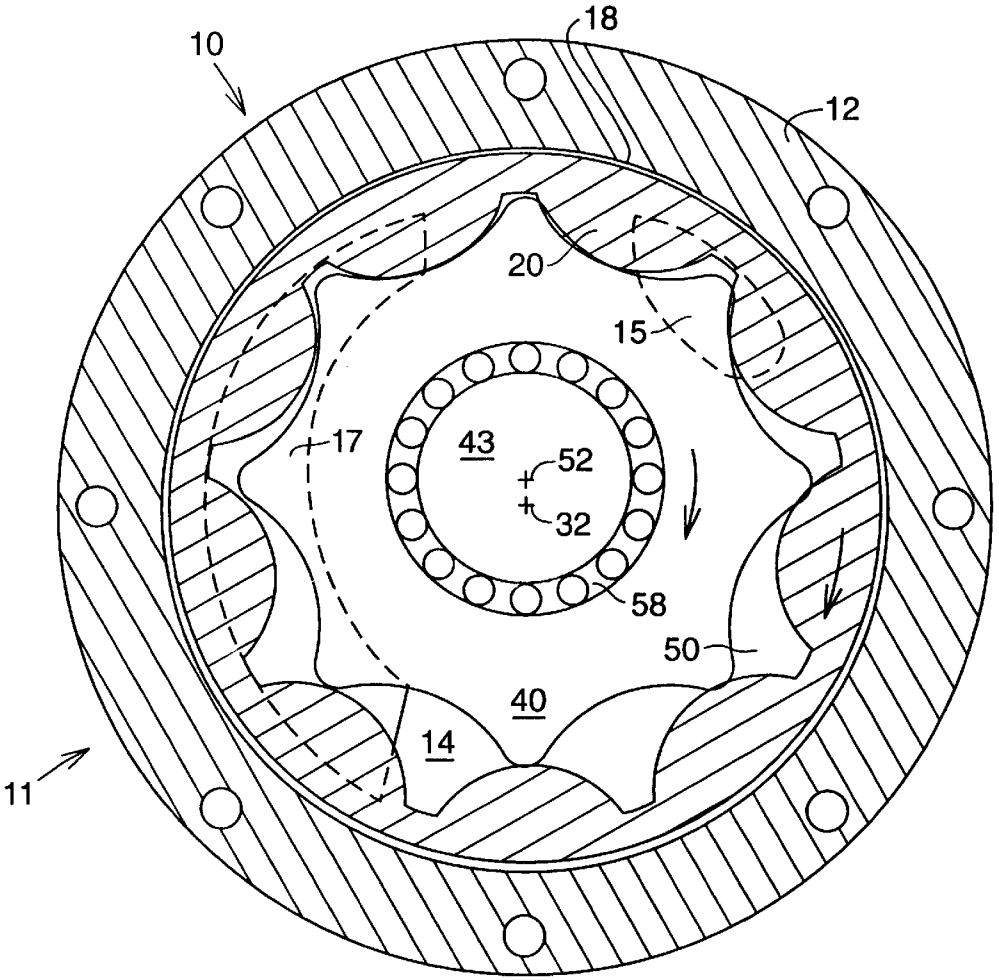
FIG. 7 is a cross-sectional end view of the present invention illustrating the inner and outer rotors along with the inlet and outlet porting configurations.

Referring to FIG. 6, outer rotor 20 has a coaxial hub 28 extending normally and outwardly from end 24 with a shaft portion of hub 28 mounted in static housing 11 by means of bearing assembly 38 which comprises static bearing housing 72 and at least one rolling element bearing. As shown, pre-loaded ball bearings 30 and 31 are used as part of bearing assembly 38 to set both the axial position and rotational axis (radial position) of outer rotor 20. The rotational axis 52 of inner rotor 40 is set by hub 7 which extends normally into bore 18 of cylindrical housing portion 12 from end plate 14. Inner rotor 40 is formed with an axial bore 43 by which inner rotor 40 is axially located for rotation about hub 7. A rolling element bearing such as roller bearing 58 is located between the shaft portion of hub 7 and inner rotor 40 and serves to reduce friction between the inner surface of bore 43 and the shaft of hub 7.

The fixed-gap clearance of interface U, the interface between the interior face 9 of end 24 and face 8 of hub 7, is maintained with bearing assembly 38. Because of the lower velocities and associated lower shear forces in this region relative to those found at the outer radial extremities of the interior surface 9 of end plate 24, it is generally sufficient to maintain the fixed clearance gap so as to avoid direct contact of the two surfaces.

The bearing assembly 38 is used to maintain the rotational axis 32 of outer rotor 20 in eccentric relation with the rotational axis 52 of the inner rotor 40 and also to maintain a fixed-gap clearance between the radial outer surface (29) of outer rotor (20) and the interior radial surface (19) of housing section 12, i.e., interface V, preferably at a distance greater than the fluid boundary layer of the operating fluid in the drive.

Bearing assembly 38 is also used to maintain the axial position of outer rotor 20. When used to maintain axial position, bearing assembly 38 functions to maintain a fixed-gap clearance 1) at interface W, the interface between face 74 of bearing and device housing 72 and the exterior face 27 of end 24 of outer rotor 20 and 2) at interface Y, the interface between end face 26 of said outer rotor 20 with the interior face 16 of housing end plate 14. The fixed-gap clearance at interface W is typically set at a distance greater than the fluid boundary layer of the operating fluid in device 10 while the fixed-gap clearance of interface Y is set at a distance that minimizes both bypass leakage and operating fluid shear forces taking into consideration that bypass leakage is a function of clearance to the third power while fluid shearing forces are inversely proportional to clearance.

Having set the fixed-gap clearance of interface Y to minimize both bypass leakage and operating fluid shear forces, the fixed-gap clearance of interfaces X and Z are not set. Since interfaces X and Z are in the region of the rotational axes of the inner and outer rotor and the inner rotor rotates relatively slower with respect to the rotating end plate of outer rotor 20 than with respect to the end plate 24, as a first approximation combined interfaces X and Z can be set equal to the total fixed-gap clearance of interface Y, that is X+Z=Y. This is conveniently accomplished by match grinding the inner and out rotor end faces to afford inner and outer rotors with identical axial lengths. The inner rotor can be ground slightly shorter or slightly longer than the outer rotor; however, when using an inner rotor with an axial length slightly longer than the outer rotor care must be taken to assure that the length of the inner rotor is less than the length of the outer rotor plus the clearance of interface Y.

Various types of rolling element bearings may be used as a part of bearing assembly 38. To control and fix the radial axis of rotor 20, a bearing with a high radial load capacity, that is, a bearing designed principally to carry a load in a direction perpendicular to the axis 32 of rotor 20 is used. To control and fix the axial position of rotor 20, a thrust bearing, that is, a bearing with a high load capacity parallel to the axis of rotation 32, is used. To control and fix both the radial and axial position of rotor 20 with respect to both radial and thrust (axial) loads, various combinations of ball, roller, thrust, tapered, or spherical bearings may be used.

Figure 8:
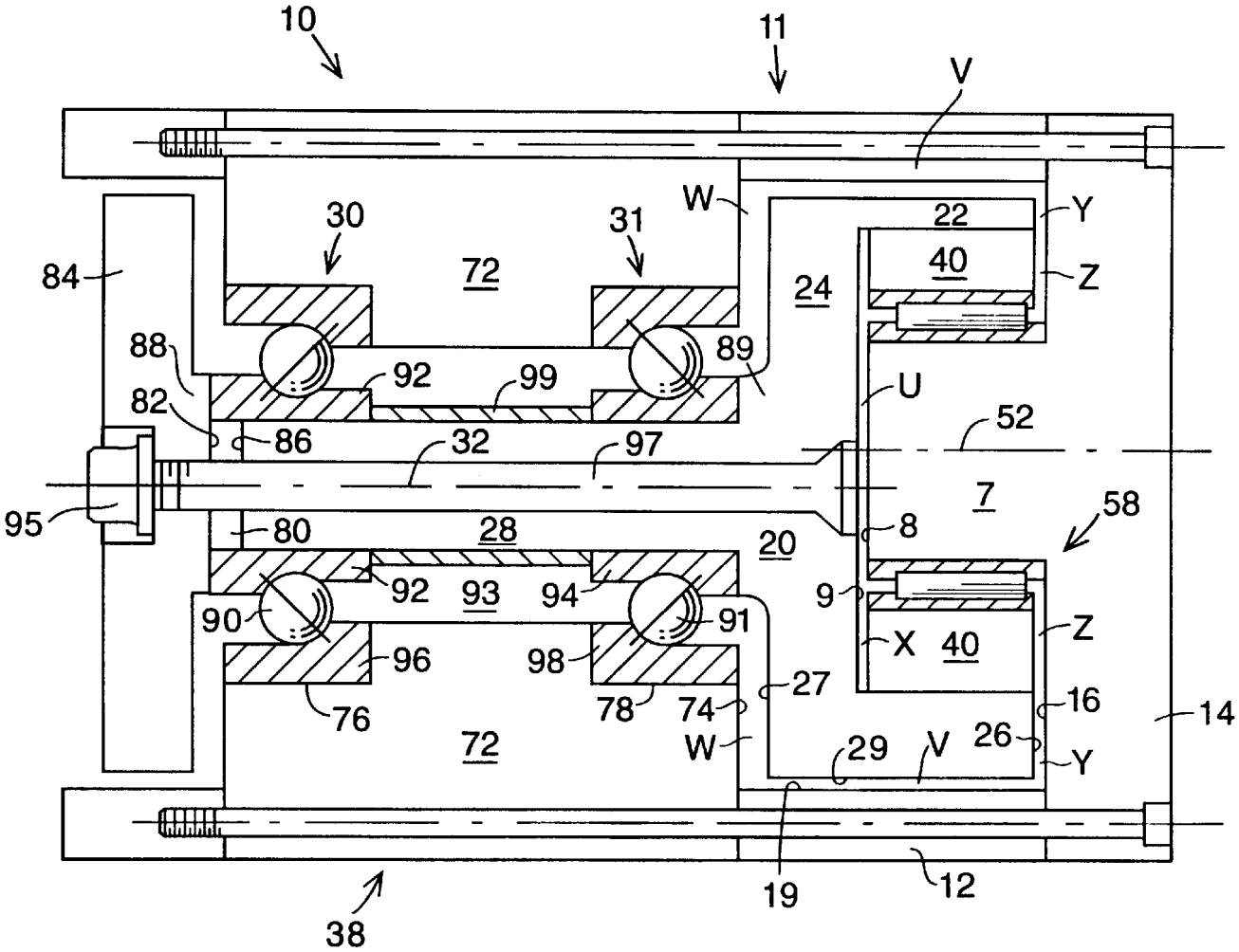
FIG. 8 is a cross-sectional view of the present invention illustrating a pre-loaded bearing assembly associated with the outer rotor and a floating inner rotor. Cross-sectional hatching for some parts has been eliminated for clarity and illustrative purposes.

Of particular significance here is the use of a pair of pre-loaded bearings. Such a bearing configuration exactly defines the rotational axis of rotor 20 and precisely fixes its axial position. For example and as shown in FIG. 8, bearing assembly 38 has a bearing housing 72 that is a part of device housing 11 and contains a pair of pre-loaded, angular contact ball bearings 30 and 31 mounted on shoulders 76 and 78 of bearing housing 72. Gap 80, defined by face 82 of flange 84, bearing race 92 and end face 86 of hub 28, allows shoulders 88 and 89 of flange 84 and rotor end 24, respectively, to place a compressive force on inner bearing races 92 and 94 of bearings 30 and 31 as a result of tightening nut and bolt, 95 and 97.

As shoulders 88 and 89 force inner races 92 and 94 toward each other in the space 93 between races 92 and 94, bearing balls 90 and 91 are forced into compressive force against the outer races 96 and 98. Collar 99 placed on hub 28 prevent bearings 30 and 31 from being placed under excessive load. Collar 99 is slightly shorter than the distance between shoulders 76,78 on the bearing housing.

Figure 9:
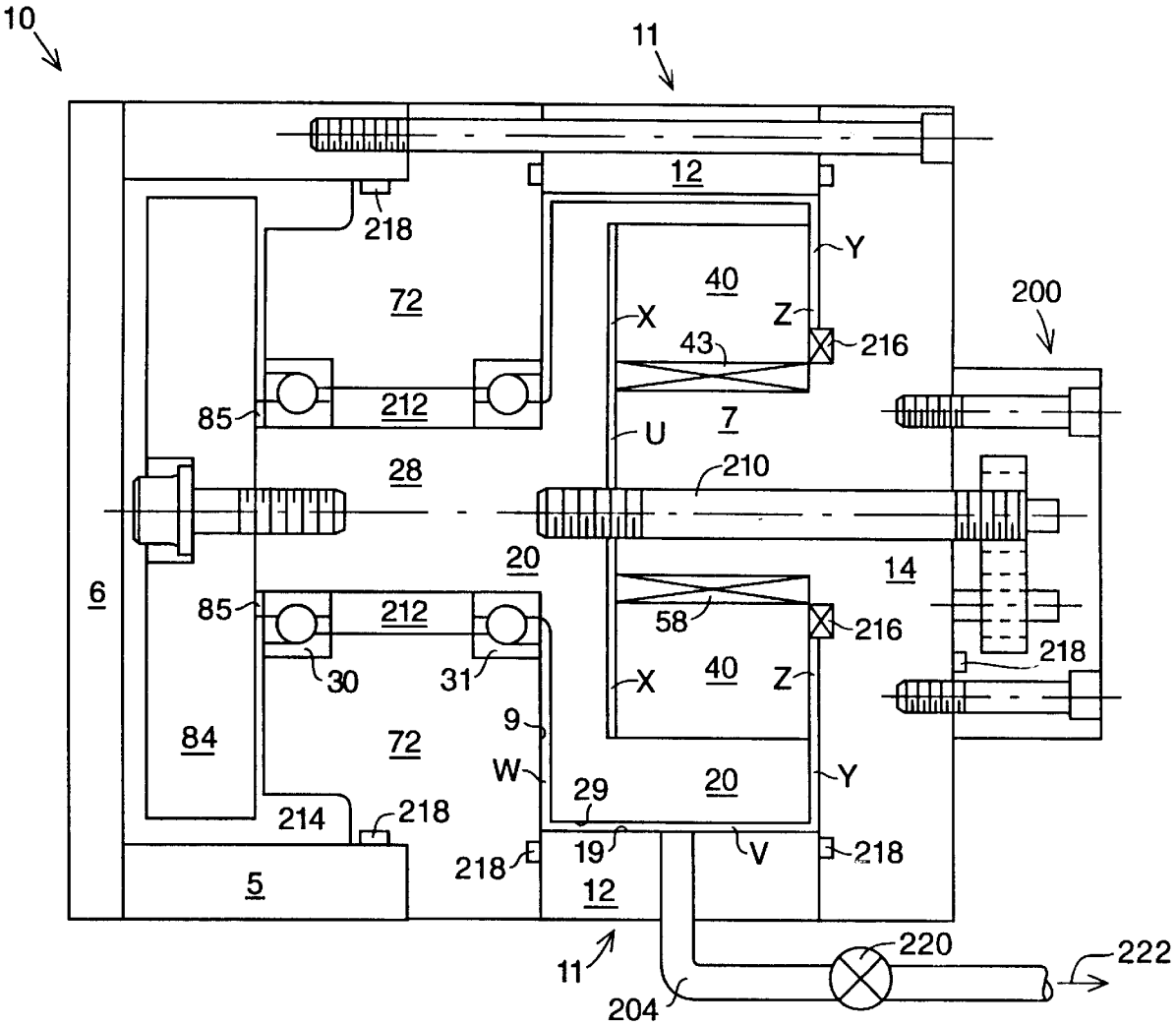
FIG. 9 is a cross-sectional view of the present invention illustrating the use of a thrust bearing to maintain a minimum inner rotor to end plate clearance, a power take-off axle from the outer rotor for use with in integrated pump and a by-pass vent and pressure control valve. Cross-sectional hatching for some parts has been eliminated for clarity and illustrative purposes.

FIGS. 5, 6, and 9 illustrate another preloaded bearing configuration in which a preload spacer 85 replaces shoulder 88 on flange 84. Contact of flange 84 with the end of hub 28 during the pre-loading process prevents bearings 30 and 31 from being subjected to excessive load and serves a function similar to that of collar 99 in FIG. 8.

Pre-loading takes advantage of the fact that deflection decreases as load increases. Thus, pre-loading leads to reduced rotor deflection when additional loads are applied to rotor 20 over that of the pre-load condition. It is to be realized that a wide variety of pre-loaded bearing configurations can be used with this invention and that the illustrations in FIGS. 5, 6, 8 and 9 are illustrative and not limiting as to any particular pre-loaded bearing configuration used with this invention.

By using a pair of pre-loaded bearings in bearing assembly 38, both the axial position and radial position of outer rotor 20 are set. As a result, it is possible to control the fixed-gap clearances at interfaces U, V, W and Y, that is, 1) the interface between end face 8 of hub 7 and the interior face 9 of end 24 (interface U), 2) the interface between the exterior face 27 of end plate 24 and the face 74 of housing element 72 (interface W), 3) the interface between end face 26 of rotor 20 and interior face 16 of end plate 14 (interface Y), and 4) the interface between radial edge 29 of rotor 20 and the interior radial edge 19 of housing portion 12 (interface V).

Preferably the fixed-gap clearance at interfaces V and W are maintained at a distance greater then the fluid boundary of the operating fluid used in the device 10. The fixed-gap clearance at interface Y is maintained at a distance that is a function of bypass leakage and operating fluid shear forces. The clearance at interface U is sufficient to prevent contact of the end face 8 of hub 7 with the interior face 9 of outer rotor end 24.

As shown in FIG. 5, device 10 can be configured such that inner rotor 40 has a coaxial hub 42 extending normally and away from the rotor gear of rotor 40 with a shaft portion of hub 42 being mounted in housing 11 with bearing assembly 51. As shown, the housing of bearing assembly 51 also serves as static end plate 14 of housing 11. Bearing assembly 51 has a rolling element bearing such as ball bearing 44 or 46 that are used to set the rotational axis 52 or the axial position of rotor 40 or both. Setting the axial position of rotor 40 maintains a fixed-gap clearance between one of the surfaces of inner rotor 40 and the other rotor 20 or housing 11. Specifically, bearing assembly 51 sets the distance of the fixed-gap clearance between 1) the interior face 16 of end plate 14 and the end face 56 of inner rotor 40 (interface Z) or 2) the distance between the interior face 9 of end plate 24 of rotor 20 and the end face 54 of inner rotor 40 (interface X). Preferably the fixed-gap clearance distance at interface X or interface Z or both are maintained at an optimal distance so as to minimize both bypass leakage and operating fluid shear forces.

An appropriate bearing 44 or 46 can be selected to set the rotational axis 56 of rotor 40, e.g., a radial load rolling element bearing, or the axial position of rotor 40 within the housing, e.g., a thrust rolling element bearing. Pairs of bearings with one bearing setting the rotational axis 52 and the other bearing setting the axial position or a tapered rolling element bearing can be used to control both the axial position of rotor 40 as well as to set its rotational axis 52. Preferably a pair of pre-loaded bearings are used to set both the axial and radial position of inner rotor 40 in a manner similar to that discussed above for outer rotor 20.

As shown in FIG. 5, an optimal configuration to reduce bypass leakage and operating fluid shear forces in the present invention includes the use of two bearing assemblies 38 and 51 with each using a pair of pre-loaded bearings to set the rotational axes and axial positions of inner rotor 40 and outer rotor 20. Such an arrangement allows for precise setting of a fixed-gap clearance at interfaces V, W, X, Y, and Z with the fixed-gap clearance at interface V and W set at a distance greater than the fluid boundary layer of the operating fluid used in device 10 and the fixed-gap clearance at interfaces X, Y, and Z set at a substantially optimal distance to minimize bypass leakage and operating fluid shear forces. The configuration in FIG. 5 is preferred over that in FIG. 6 in that the fixed-gap clearances at interfaces X, Y, and Z are un-effected by unbalanced hydraulic forces on rotors 20 and 40. Alternatively, and as shown in FIG. 9, a thrust bearing 216 can be incorporated into the basic design of FIG. 6 to more precisely control the clearance at interfaces X and Z. As operating pressure increases in the device, unbalanced hydraulic forces on inner rotor 40 tend to force it toward stationary port plate 14. If the pressure becomes sufficiently high, the hydraulic force can exceed the fluid film hydrodynamic force between rotor 40 and end plate 14 causing contact to occur. Addition of thrust bearing 216 in a groove in either the end plate 14 or in inner rotor 40, i.e., between the inner rotor 40 and plate 14 eliminates contact of the surfaces and additionally sets a minimum fixed-gap clearance at interface Z.

When used as an engine in Rankine cycle configurations, the present invention affords several improvements over turbine-type devices where condensed fluid is destructive to the turbine blade structure and, as a result, it is necessary to prevent two-phase formation when using blade-type devices. In fact, two-phase fluids can be used to advantage to increase the efficiency of the present invention. Thus when used with fluids that tend to superheat, the superheat enthalpy can be used to vaporize additional operating liquid when the device is used as an expansion engine thereby increasing the volume of vapor and furnishing additional work of expansion. For working fluids that tend to condense upon expansion, maximum work can be extracted if some condensation is allowed in expansion engine 10. When using mixed-phased fluids, the fixed-gap clearance distance must be set to minimize by-pass leakage and fluid shear loses given the ratio of liquid and vapor in engine 10.

Figure 10:
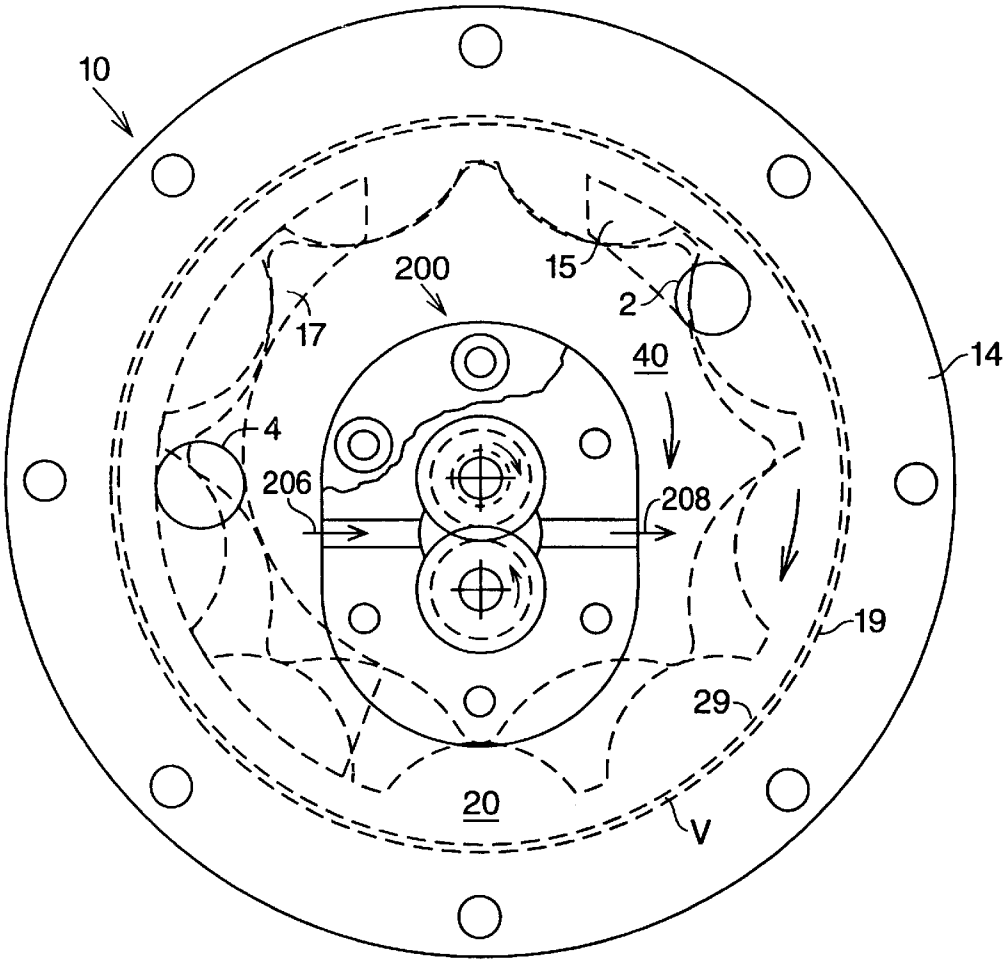
FIG. 10 is a partially cut-away end view of the embodiment of FIG. 9.
Figure 11:
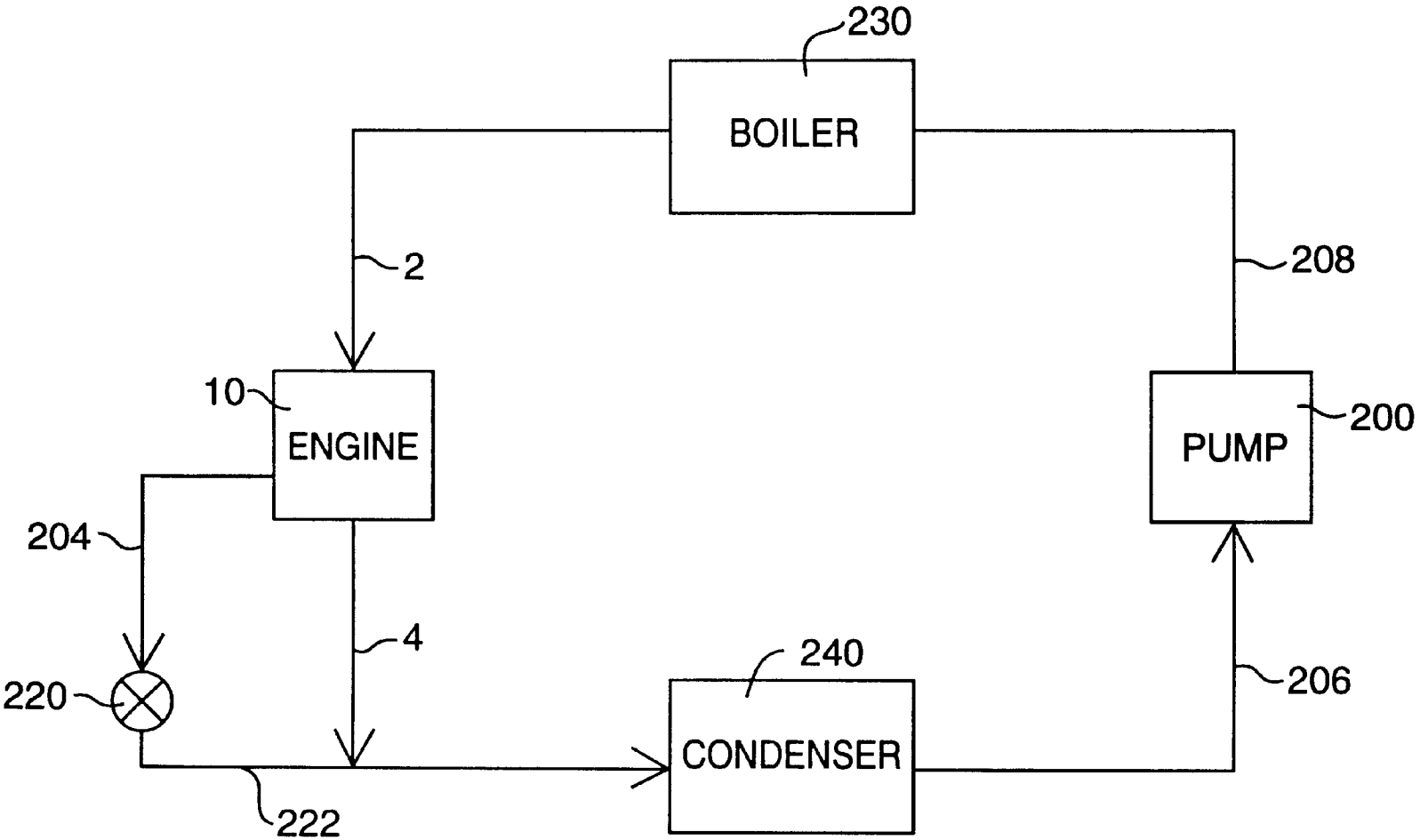
FIG. 11 is a schematic view illustrating the use of the present invention as an engine in a Rankine cycle.

FIGS. 9–11 show the present device as employed in a typical Rankine cycle. Referring to FIG. 11, high pressure vapor (including some superheated liquid) from boiler 230 serves as the motive force to drive device 10 as an engine or prime mover and is conveyed from the boiler 230 to the inlet port 15 via conduit 2. Low pressure vapor leaves the device via exhaust port 17 and passes to condenser 240 via conduit 4. Liquid is pumped from condenser 240 through line 206 by means of pump 200 to boiler 230 through conduit 208 after which the cycle is repeated.

As seen in FIGS. 9 and 10, a condensate pump 200 can be operated off of shaft 210 driven by outer rotor 20. When a "fixed" inner rotor assembly is used (FIG. 5), the condensate pump can be driven directly by shaft 42 of the inner rotor.

The use of an integrated condensate pump 200 contributes to overall system efficiency in view of the fact that there are no power conversion losses to a pump separated from the engine. Hermetic containment of the working fluid is easily accomplished as leakage about pump shaft 210 of pump 200 is into the engine housing 11. As shown, device 10 can be easily sealed by adding a second annular housing member 5 and a second end plate 6. Alternatively housing member 5 and end plate 6 can be combined into an integral end cap (not shown) A seal on pump shaft 210 is not required and seal losses are eliminated.

Since the condensate pump 200 is synchronized with engine 10, fluid mass flow rate in Rankine type cycles is the same through the engine 10 and condensate pump 210. With engine and pump synchronized, the condensate pump capacity is exact at any engine speed thereby eliminating wasted power from using overcapacity pumps.

In typical applications, some by-pass leakage occurs at interface Y (between face 26 of the inner rotor and interior face 16 of end plate 14) into the outer extremes of the interior of housing 11, e.g., interface V and W and spaces such as void spaces 212 and 214. Such fluid build-up, especially in the fixed-gap at interfaces V and W, leads to unnecessary fluid shear losses. To eliminate such losses, a simple passage such as conduit 204 is used to communicate the interior of housing 11 with the low pressure side of device 10. Thus for an expansion engine, the housing interior is vented to the exhaust conduit 4 by means of conduit 204 (FIG. 11). Such venting also minimizes the stress on housing 11 which is of special concern when non-metallic materials are used for the construction of at least parts of housing 11 such as when device 10 is linked to an external drive by means of a coupling window, e.g., the use of a magnetic drive in plate 84 that is coupled to another magnetic plate (not shown) through non-magnetic window 6.

Typically device 10 works most efficiently when the housing interior (case chamber) pressure is maintained between the inlet and exhaust pressures. A positive pressure in the case negates part of the bypass leakage at interface Y. Housing seals 218 are used as appropriate. A pressure control valve, such as an automatic or manual throttle valve 220, allows for optimization of the housing pressure for maximum operating efficiency.

It is possible that changes in configurations to other than those shown could be used but that which is shown if preferred and typical. Without departing from the spirit of this invention, various means of fastening the components together may be used.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

I claim:

1. A rotary, chambered, fluid energy-transfer device comprising:

(a) a housing comprising:
  (1) a housing cylindrical portion having a bore formed therein;
  (2) a housing end plate having:
    a) an inlet passage;
    b) an outlet passage; and
    c) a hub extending therefrom;

(b) an outer rotor with a female gear profile rotating in said bore of said housing cylindrical portion and comprising:
  (1) a radial portion;
  (2) a female gear profile formed in said radial portion;
  (3) a first end covering said female gear profile; and
  (4) a second end skirting said female gear profile;

(c) an inner rotor with:
  (1) a male gear profile in operative engagement with said outer rotor;
  (2) a central bore portion by which said inner rotor is located for rotation about said hub; and (3) said hub setting the rotational axis of said inner rotor;

(d) said outer rotor having a coaxial hub extending normally from said outer rotor with said coaxial hub being mounted in said housing with a bearing assembly comprising a first rolling element bearing, said bearing assembly:

(1) setting at least one of:

a) a rotational axis of said outer rotor; and b) an axial position of said outer rotor; and (2) maintaining a fixed-gap clearance of said outer rotor with at least one surface of a) said housing; and b) said inner rotor; and (e) a second rolling element bearing located between said housing end plate and said inner rotor and maintaining a minimum fixed-gap clearance of said inner rotor with said housing end plate.

2. The fluid energy-transfer device of claim 1 wherein said fixed-gap clearance is a distance greater than the fluid boundary layer of an operating fluid used in said device.

3. The fluid energy-transfer device of claim 1 wherein said fixed-gap clearance is a substantially optimal distance as a function of bypass leakage and operating fluid shear forces.

4. The fluid energy-transfer device of claim 1 further comprising a rolling element bearing positioned between said hub and an inner surface of said central bore portion of said inner rotor.

5. The fluid energy-transfer device of claim 1 wherein said second rolling element bearing is a thrust bearing.

6. The fluid energy-transfer device of claim 1 with said fixed-gap clearance being between an interior surface of said first end of said outer rotor and an end face of said hub extending from said housing end plate and with said axial position of said outer rotor set with said bearing assembly so as to maintain said fixed-gap clearance.

7. The fluid energy-transfer device of claim 1 with said bearing assembly setting said rotational axis of said outer rotor.

8. The fluid energy-transfer device of claim 7 with said fixed-gap clearance being between a radial outer surface of said radial portion of said outer rotor and an inner radial surface of said housing cylindrical portion and with said rotational axis of said outer rotor set by said bearing assembly so as to maintain said fixed-gap clearance at a distance greater than a fluid boundary layer of an operating fluid in said device.

9. The fluid energy-transfer device of claim 1 with said bearing assembly setting said axial position of said outer rotor.

10. The fluid energy-transfer device of claim 9 with said axial position of said outer rotor set so as to maintain a fixed-gap clearance of said first end of said outer rotor with said housing at a distance greater than a fluid boundary layer of an operating fluid in said device.

11. The fluid energy-transfer device of claim 9 with said axial position of said outer rotor set so as to maintain a fixed-gap clearance of said second end of said outer rotor with said housing end plate at a substantially optimal distance as a function of bypass leakage and operating fluid shear forces.

12. The fluid energy-transfer device of claim 1 with said bearing assembly comprising a second rolling element bearing mounted in a pre-loaded configuration with said first rolling element bearing.

13. The fluid energy-transfer device of claim 12 with said bearing assembly setting said axial position of said outer rotor and said rotational axis of said outer rotor.

14. The fluid energy-transfer device of claim 13 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

15. The fluid energy-transfer device of claim 13 with said axial position of said outer rotor set so as to maintain a fixed-gap clearance of said first end of said outer rotor with said housing at a distance greater than a fluid boundary layer of an operating fluid in said device.

16. The fluid energy-transfer device of claim 13 with said axial position of said outer rotor set so as to maintain a fixed-gap clearance of said second end of said outer rotor with said housing end plate at a substantially optimal distance as a function of bypass leakage and operating fluid shear forces.

17. The fluid energy-transfer device of claim 13

(a) with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device; and (b) with said axial position of said outer rotor set so as to maintain a fixed-gap clearance:

(1) of said first end of said outer rotor with said housing at a distance greater than a fluid boundary layer of an operating fluid in said device; and (2) of said second end of said outer rotor with said housing end plate at a substantially optimal distance as a function of bypass leakage and operating fluid shear forces.

18. The fluid energy-transfer device of claim 17 wherein said rolling element bearing is a thrust bearing.

19. The fluid energy-transfer device of claim 1 wherein said device is used as a prime mover.

20. The fluid energy-transfer device of claim 19 wherein a pressurized operating fluid is used in said device to provide a motive force.

21. The fluid energy-transfer device of claim 20 wherein said inlet passage and said outlet passage of said housing end plate are configured for optimum expansion of said pressurized fluid in said device.

22. The fluid energy-transfer device of claim 20 wherein said pressurized fluid is in both a gaseous and a liquid state.

23. The fluid energy-transfer device of claim 20 wherein said pressurized fluid is in a gaseous state.

24. The fluid energy-transfer device of claim 19 further comprising an integrated condensate pump driven from an output shaft of said device.

25. The fluid energy-tansfer device of claim 1 wherein said device is hermetically sealed.

26. The fluid energy-transfer device of claim 1 wherein said device is magnetically coupled with an external rotational shaft.

27. The fluid energy-transfer device of claim 1 further comprising a conduit for venting operating fluid from an internal housing cavity.

28. The fluid energy-transfer device of claim 27 wherein said operating fluid is vented to said outlet passage.

29. The fluid energy-transfer device of claim 27 with said conduit further comprising a pressure regulating valve.

30. The fluid energy-transfer device of claim 1 wherein said device is used as a compressor.

31. The fluid energy-transfer device of claim 30 wherein said inlet passage and said outlet passage of said housing end plate are configured for optimum compression of said fluid.

32. A rotary, chambered, fluid energy-transfer device comprising:

(a) a housing comprising:
  (1) a housing cylindrical portion having a bore formed therein;
  (2) a housing end plate having:
    a) an inlet passage;
    b) an outlet passage; and
    c) a hub extending therefrom;

(b) an outer rotor with a female gear profile rotating in said bore of said housing cylindrical portion and comprising:
  (1) a radial portion;
  (2) a female gear profile formed in said radial portion;
  (3) a first end covering said female gear profile; and
  (4) a second end skirting said female gear profile;

(c) an inner rotor with:
  (1) a male gear profile in operative engagement with said outer rotor;
  (2) a central bore portion by which said inner rotor is located for rotation about said hub; and
  (3) said hub setting the rotational axis of said inner rotor; and (d) said outer rotor having a coaxial hub extending normally from said outer rotor with said coaxial hub being mounted in said housing with a bearing assembly comprising a rolling element bearing, said bearing assembly:
  (1) maintaining a fixed-gap clearance between an interior surface of said first end of said outer rotor and an end face of said hub extending from said housing end plate; and
  (2) setting an axial position of said outer rotor so as to maintain said fixed-gap clearance.

33. The fluid energy-transfer device of claim 32 wherein said fixed-gap clearance is a distance greater than the fluid boundary layer of an operating fluid used in said device.

34. The fluid energy-transfer device of claim 32 wherein said fixed-gap clearance is a substantially optimal distance as a function of bypass leakage and operating fluid shear forces.

35. The fluid energy-transfer device of claim 32 further comprising a rolling element bearing positioned between said hub and an inner surface of said central bore portion of said inner rotor.

36. The fluid energy-transfer device of claim 32 further comprising a rolling element bearing located between said housing end plate and said inner rotor.

37. The fluid energy-transfer device of claim 36 wherein said rolling element bearing is a thrust bearing.

38. The fluid energy-transfer device of claim 32 with said bearing assembly setting a rotational axis of said outer rotor.

39. The fluid energy-transfer device of claim 38 with a fixed-gap clearance between a radial outer surface of said radial portion of said outer rotor and an inner radial surface of said housing cylindrical portion and with said rotational axis of said outer rotor set by said bearing assembly so as to maintain said fixed-gap clearance at a distance greater than a fluid boundary layer of an operating fluid in said device.

40. The fluid energy-transfer device of claim 32 with said axial position of said outer rotor set so as to maintain a fixed-gap clearance of said first end of said outer rotor with said housing at a distance greater than a fluid boundary layer of an operating fluid in said device.

41. The fluid energy-transfer device of claim 40 with said axial position of said outer rotor set so as to maintain a fixed-gap clearance of said second end of said outer rotor with said housing end plate at a substantially optimal distance as a function of bypass leakage and operating fluid shear forces.

42. The fluid energy-transfer device of claim 32 with said bearing assembly comprising a second rolling element bearing mounted in a pre-loaded configuration with said first rolling element bearing.

43. The fluid energy-transfer device of claim 42 with said bearing assembly setting said axial position of said outer rotor and a rotational axis of said outer rotor.

44. The fluid energy-transfer device of claim 43 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

45. The fluid energy-transfer device of claim 43 with said axial position of said outer rotor set so as to maintain a fixed-gap clearance of said first end of said outer rotor with said housing at a distance greater than a fluid boundary layer of an operating fluid in said device.

46. The fluid energy-transfer device of claim 43 with said axial position of said outer rotor set so as to maintain a fixed-gap clearance of said second end of said outer rotor with said housing end plate at a substantially optimal distance as a function of bypass leakage and operating fluid shear forces.

47. The fluid energy-transfer device of claim 43

(a) with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device; and (b) with said axial position of said outer rotor set so as to maintain a fixed-gap clearance:
  a) of said first end of said outer rotor with said housing at a distance greater than a fluid boundary layer of an operating fluid in said device; and
  b) of said second end of said outer rotor with said housing end plate at a substantially optimal distance as a function of bypass leakage and operating fluid shear forces.

48. The fluid energy-transfer device of claim 47 further comprising a rolling element bearing located between said housing end plate and said inner rotor.

49. The fluid energy-transfer device of claim 48 wherein said rolling element bearing located between said housing end plate and said inner rotor is a thrust bearing.

50. The fluid energy-transfer device of claim 48 with said rolling element bearing located between said housing end plate and said inner rotor maintaining a minimum fixed-gap clearance of said inner rotor with said housing end plate.

51. The fluid energy-transfer device of claim 32 wherein said device is used as a prime mover.

52. The fluid energy-transfer device of claim 51 wherein a pressurized operating fluid is used in said device to provide a motive force.

53. The fluid energy-transfer device of claim 52 wherein said inlet passage and said outlet passage of said housing end plate are configured for optimum expansion of said pressurized fluid in said device.

54. The fluid energy-transfer device of claim 52 wherein said pressurized fluid is in both a gaseous and a liquid state.

55. The fluid energy-transfer device of claim 52 wherein said pressurized fluid is in a gaseous state.

56. The fluid energy-transfer device of claim 51 further comprising an integrated condensate pump driven from an output shaft of said device.

57. The fluid energy-transfer device of claim 32 wherein said device is hermetically sealed.

58. The fluid energy-transfer device of claim 32 wherein said device is magnetically coupled with an external rotational shaft.

59. The fluid energy-transfer device of claim 32 further comprising a conduit for venting operating fluid from an internal housing cavity.

60. The fluid energy-transfer device of claim 59 wherein said operating fluid is vented to said outlet passage.

61. The fluid energy-transfer device of claim 59 with said conduit further comprising a pressure regulating valve.

62. The fluid energy-transfer device of claim 32 wherein said device is used as a compressor.

63. The fluid energy-transfer device of claim 62 wherein said inlet passage and said outlet passage of said housing end plate are configured for optimum compression of said fluid.

64. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion of said housing and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said outer rotor having a coaxial hub extending normally from said outer rotor with said hub being mounted in said housing with a bearing assembly comprising a first rolling element bearing, said bearing assembly:
  1) setting an axial position of said outer rotor; and
  2) maintaining a fixed-gap clearance of said first end of said outer rotor with said housing at a distance greater than a fluid boundary layer of an operating fluid in said device.

65. The fluid energy-transfer device of claim 64 with said housing end plate comprising a hub extending therefrom and setting the rotational axis of said inner rotor, said inner rotor having a central bore portion by which said inner rotor is located for rotation about said hub.

66. The fluid energy-transfer device of claim 65 further comprising a rolling element bearing positioned between said hub and an inner surface of said central bore portion of said inner rotor.

67. The fluid energy-transfer device of claim 64 further comprising a rolling element bearing located between said housing end plate and said inner rotor.

68. The fluid energy-transfer device of claim 67 wherein said rolling element bearing located between said housing end plate and said inner rotor is a thrust bearing.

69. The fluid energy-transfer device of claim 64 with said bearing assembly setting a rotational axis of said outer rotor.

70. The fluid energy-transfer device of claim 69 with a fixed-gap clearance between a radial outer surface of said radial portion of said outer rotor and an inner radial surface of said housing cylindrical portion and with said rotational axis of said outer rotor set by said bearing assembly so as to maintain said fixed-gap clearance at a distance greater than a fluid boundary layer of an operating fluid in said device.

71. The fluid energy-transfer device of claim 64 with said axial position of said outer rotor set so as to maintain a fixed-gap clearance of said second end of said outer rotor with said housing end plate at a substantially optimal distance as a function of bypass leakage and operating fluid shear forces.

72. The fluid energy-transfer device of claim 64 with said bearing assembly comprising a second rolling element bearing mounted in a pre-loaded configuration with said first rolling element bearing.

73. The fluid energy-transfer device of claim 72 with said bearing assembly setting a rotational axis of said outer rotor.

74. The fluid energy-transfer device of claim 73 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

75. The fluid energy-transfer device of claim 73 with said axial position of said outer rotor set so as to maintain a fixed-gap clearance of said second end of said outer rotor with said housing end plate at a substantially optimal distance as a function of bypass leakage and operating fluid shear forces.

76. The fluid energy-transfer device of claim 73

(a) with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device;

(b) with said axial position of said outer rotor set so as to maintain a fixed-gap clearance of said second end of said outer rotor with said housing end plate at a substantially optimal distance as a function of bypass leakage and operating fluid shear forces.

77. The fluid energy-transfer device of claim 76 further comprising a rolling element bearing located between said housing end plate and said inner rotor.

78. The fluid energy-transfer device of claim 77 wherein said rolling element bearing located between said housing end plate and said inner rotor is a thrust bearing.

79. The fluid energy-transfer device of claim 77 with said rolling element bearing located between said housing end plate and said inner rotor maintaining a minimum fixed-gap clearance of said inner rotor with said housing end plate.

80. The fluid energy-transfer device of claim 64 wherein said device is used as a prime mover.

81. The fluid energy-transfer device of claim 80 wherein a pressurized operating fluid is used in said device to provide a motive force.

82. The fluid energy-transfer device of claim 81 wherein said inlet passage and said outlet passage of said housing end plate are configured for optimum expansion of said pressurized fluid in said device.

83. The fluid energy-transfer device of claim 81 wherein said pressurized fluid is in both a gaseous and a liquid state.

84. The fluid energy-transfer device of claim 81 wherein said pressurized fluid is in a gaseous state.

85. The fluid energy-transfer device of claim 80 further comprising an integrated condensate pump driven from an output shaft of said device.

86. The fluid energy-transfer device of claim 64 wherein said device is hermetically sealed.

87. The fluid energy-transfer device of claim 64 wherein said device is magnetically coupled with an external rotational shaft.

88. The fluid energy-transfer device of claim 64 further comprising a conduit for venting operating fluid from an internal housing cavity.

89. The fluid energy-transfer device of claim 88 wherein said operating fluid is vented to said outlet passage.

90. The fluid energy-transfer device of claim 88 with said conduit further comprising a pressure regulating valve.

91. The fluid energy-transfer device of claim 64 wherein said device is used as a compressor.

92. The fluid energy-transfer device of claim 91 wherein said inlet passage and said outlet passage of said housing end plate are configured for optimum compression of said fluid.

93. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore 18 of said housing cylindrical portion of said housing and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said outer rotor having a coaxial hub extending normally from said outer rotor with said hub being mounted in said housing with a bearing assembly comprising a first rolling element bearing, said bearing assembly:
  (1) setting an axial position of said outer rotor; and
  (2) maintaining a fixed-gap clearance of said of said second end of said outer rotor with said housing end plate at a substantially optimal distance as a function of bypass leakage and operating fluid shear forces.

94. The fluid energy-transfer device of claim 93 with said housing end plate comprising a hub extending therefrom and setting the rotational axis of said inner rotor, said inner rotor having a central bore portion by which said inner rotor is located for rotation about said hub.

95. The fluid energy-transfer device of claim 94 further comprising a rolling element bearing positioned between said hub and an inner surface of said central bore portion of said inner rotor.

96. The fluid energy-transfer device of claim 94 further comprising a rolling element bearing located between said housing end plate and said inner rotor.

97. The fluid energy-transfer device of claim 96 wherein said rolling element bearing located between said housing end plate and said inner rotor is a thrust bearing.

98. The fluid energy-transfer device of claim 93 with said bearing assembly setting a rotational axis of said outer rotor.

99. The fluid energy-transfer device of claim 98 with a fixed-gap clearance between a radial outer surface of said radial portion of said outer rotor and an inner radial surface of said housing cylindrical portion and with said rotational axis of said outer rotor set by said bearing assembly so as to maintain said fixed-gap clearance at a distance greater than a fluid boundary layer of an operating fluid in said device.

100. The fluid energy-transfer device of claim 93 with said bearing assembly comprising a second rolling element bearing mounted in a pre-loaded configuration with said first rolling element bearing.

101. The fluid energy-transfer device of claim 100 with said bearing assembly setting a rotational axis of said outer rotor.

102. The fluid energy-transfer device of claim 101 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

103. The fluid energy-transfer device of claim 101 with said axial position of said outer rotor set so as to maintain a fixed-gap clearance of said second end of said outer rotor with said housing end plate at a substantially optimal distance as a function of bypass leakage and operating fluid shear forces.

104. The fluid energy-transfer device of claim 101

(a) with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device; and (b) with said axial position of said outer rotor set so as to maintain a fixed-gap clearance of said first end of said outer rotor with said housing at a distance greater than a fluid boundary layer of an operating fluid in said device.

105. The fluid energy-transfer device of claim 104 further comprising a rolling element bearing located between said housing end plate and said inner rotor.

106. The fluid energy-transfer device of claim 105 wherein said rolling element bearing located between said housing end plate and said inner rotor is a thrust bearing.

107. The fluid energy-transfer device of claim 105 with said rolling element bearing located between said housing end plate and said inner rotor maintaining a minimum fixed-gap clearance of said inner rotor with said housing end plate.

108. The fluid energy-transfer device of claim 93 wherein said device is used as a prime mover.

109. The fluid energy-transfer device of claim 108 wherein a pressurized operating fluid is used in said device to provide a motive force.

110. The fluid energy-transfer device of claim 109 wherein said inlet passage and said outlet passage of said housing end plate are configured for optimum expansion of said pressurized fluid in said device.

111. The fluid energy-transfer device of claim 109 wherein said pressurized fluid is in both a gaseous and a liquid state.

112. The fluid energy-transfer device of claim 109 wherein said pressurized fluid is in a gaseous state.

113. The fluid energy-transfer device of claim 108 further comprising an integrated condensate pump driven from an output shaft of said device.

114. The fluid energy-transfer device of claim 93 wherein said device is hermetically sealed.

115. The fluid energy-transfer device of claim 93 wherein said device is magnetically coupled with an external rotational shaft.

116. The fluid energy-transfer device of claim 93 further comprising a conduit for venting operating fluid from an internal housing cavity.

117. The fluid energy-transfer device of claim 116 wherein said operating fluid is vented to said outlet passage.

118. The fluid energy-transfer device of claim 116 with said conduit further comprising a pressure regulating valve.

119. The fluid energy-transfer device of claim 93 wherein said device is used as a compressor.

120. The fluid energy-transfer device of claim 119 wherein said inlet passage and said outlet passage of said housing end plate are configured for optimum compression of said fluid.

121. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion of said housing and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said outer rotor having a coaxial hub extending normally from said outer rotor with said hub being mounted in said housing with a bearing assembly comprising a first rolling element bearing and a second rolling element bearing mounted in a pre-loaded configuration, said bearing assembly:
  1) setting at least one of:
    a) a rotational axis of said selected rotor; and
    b) an axial position of said selected rotor; and
  2) maintaining a fixed-gap clearance of said selected rotor with at least one surface of
    a) said housing; and
    b) said other rotor.

122. The fluid energy-transfer device of claim 121 wherein said fixed-gap clearance is a distance greater than the fluid boundary layer of an operating fluid used in said device.

123. The fluid energy-transfer device of claim 121 wherein said fixed-gap clearance is a substantially optimal distance as a function of bypass leakage and operating fluid shear forces.

124. The fluid energy-transfer device of claim 121 with said housing end plate comprising a hub extending therefrom and setting the rotational axis of said inner rotor, said inner rotor having a central bore portion by which said inner rotor is located for rotation about said hub.

125. The fluid energy-transfer device of claim 124 further comprising a rolling element bearing positioned between said hub and an inner surface of said central bore portion of said inner rotor.

126. The fluid energy-transfer device of claim 124 further comprising a rolling element bearing located between said housing end plate and said inner rotor.

127. The fluid energy-transfer device of claim 126 wherein said rolling element bearing located between said housing end plate and said inner rotor is a thrust bearing.

128. The fluid energy-transfer device of claim 124 with said rolling element bearing located between said housing end plate and said inner rotor maintaining a minimum fixed-gap clearance of said inner rotor with said housing end plate.

129. The fluid energy-transfer device of claim 124 with said fixed-gap clearance being between an interior surface of said first end of said outer rotor and an end face of said hub extending from said housing end plate and with said axial position of said outer rotor set with said bearing assembly so as to maintain said fixed-gap clearance.

130. The fluid energy-transfer device of claim 121 with said bearing assembly setting said rotational axis of said outer rotor.

131. The fluid energy-transfer device of claim 130 with said fixed-gap clearance being between a radial outer surface of said radial portion of said outer rotor and an inner radial surface of said housing cylindrical portion and with said rotational axis of said outer rotor set by said bearing assembly so as to maintain said fixed-gap clearance at a distance greater than a fluid boundary layer of an operating fluid in said device.

132. The fluid energy-transfer device of claim 121 with said bearing assembly setting said axial position of said outer rotor.

133. The fluid energy-transfer device of claim 132 with said axial position of said outer rotor set so as to maintain a fixed-gap clearance of said first end of said outer rotor with said housing at a distance greater than a fluid boundary layer of an operating fluid in said device.

134. The fluid energy-transfer device of claim 132 with said axial position of said outer rotor set so as to maintain a fixed-gap clearance of said second end of said outer rotor with said housing end plate at a substantially optimal distance as a function of bypass leakage and operating fluid shear forces.

135. The fluid energy-transfer device of claim 121 with said bearing assembly setting said axial position of said outer rotor and said rotational axis of said outer rotor.

136. The fluid energy-transfer device of claim 135 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

137. The fluid energy-transfer device of claim 135 with said axial position of said outer rotor set so as to maintain a fixed-gap clearance of said first end of said outer rotor with said housing at a distance greater than a fluid boundary layer of an operating fluid in said device.

138. The fluid energy-transfer device of claim 135 with said axial position of said outer rotor set so as to maintain a fixed-gap clearance of said second end of said outer rotor with said housing end plate at a substantially optimal distance as a function of bypass leakage and operating fluid shear forces.

139. The fluid energy-transfer device of claim 135

(a) with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device; and (b) with said axial position of said outer rotor set so as to maintain a fixed-gap clearance:
  (1) of said first end of said outer rotor with said housing at a distance greater than a fluid boundary layer of an operating fluid in said device; and
  (2) of said second end of said outer rotor with said housing end plate at a substantially optimal distance as a function of bypass leakage and operating fluid shear forces.

140. The fluid energy-transfer device of claim 139 further comprising a rolling element bearing located between said housing end plate and said inner rotor.

141. The fluid energy-transfer device of claim 140 wherein said rolling element bearing is a thrust bearing.

142. The fluid energy-transfer device of claim 140 with said rolling element bearing located between said housing end plate and said inner rotor maintaining a minimum fixed-gap clearance of said inner rotor with said housing end plate.

143. The fluid energy-transfer device of claim 121 wherein said device is used as a prime mover.

144. The fluid energy-transfer device of claim 143 wherein a pressurized operating fluid is used in said device to provide a motive force.

145. The fluid energy-transfer device of claim 144 wherein said inlet passage and said outlet passage of said housing end plate are configured for optimum expansion of said pressurized fluid in said device.

146. The fluid energy-transfer device of claim 144 wherein said pressurized fluid is in both a gaseous and a liquid state.

147. The fluid energy-transfer device of claim 144 wherein said pressurized fluid is in a gaseous state.

148. The fluid energy-transfer device of claim 143 further comprising an integrated condensate pump driven from an output shaft of said device.

149. The fluid energy-transfer device of claim 121 wherein said device is hermetically sealed.

150. The fluid energy-transfer device of claim 121 wherein said device is magnetically coupled with an external rotational shaft.

151. The fluid energy-transfer device of claim 121 further comprising a conduit for venting operating fluid from an internal housing cavity.

152. The fluid energy-transfer device of claim 151 wherein said operating fluid is vented to said outlet passage.

153. The fluid energy-transfer device of claim 151 with said conduit further comprising a pressure regulating valve.

154. The fluid energy-transfer device of claim 121 wherein said device is used as a compressor.

155. The fluid energy-transfer device of claim 154 wherein said inlet passage and said outlet passage of said housing end plate are configured for optimum compression of said fluid.

156. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said inner rotor having a coaxial hub extending normally from said inner rotor with said coaxial hub being mounted in said housing with a bearing assembly comprising a rolling element bearing, said bearing assembly:
  (1) setting an axial position of said inner rotor; and
  (2) maintaining a fixed-gap clearance of said first end of said inner rotor with an inner wall of said first end of said outer rotor at a substantially optimal distance as a function of bypass leakage and operating fluid shear forces.

157. The fluid energy-transfer device of claim 156 with said axial position of said inner rotor set so as to maintain a fixed-gap clearance of said second end of said inner rotor with said housing end plate at a substantially optimal distance as a function of bypass leakage and operating fluid shear forces.

158. The fluid energy-transfer device of claim 156 with said bearing assembly comprising a second rolling element bearing mounted in a pre-loaded configuration with said first rolling element bearing.

159. The fluid energy-transfer device of claim 158 with said bearing assembly setting said axial position of said inner rotor and a rotational axis of said inner rotor.

160. The fluid energy-transfer device of claim 158 with said axial position of said inner rotor set so as to maintain a fixed-gap clearance of said second end of said inner rotor with said housing end plate at a substantially optimal distance as a function of bypass leakage and operating fluid shear forces.

161. The fluid energy-transfer device of claim 156 wherein said device is used as a prime mover.

162. The fluid energy-transfer device of claim 161 wherein a pressurized operating fluid is used in said device to provide a motive force.

163. The fluid energy-transfer device of claim 162 wherein said inlet passage and said outlet passage of said end plate are configured for optimum expansion of said pressurized fluid in said device.

164. The fluid energy-transfer device of claim 162 wherein said pressurized fluid is in both a gaseous and a liquid state.

165. The fluid energy-transfer device of claim 162 wherein said pressurized fluid is in a gaseous state.

166. The fluid energy-transfer device of claim 161 further comprising an integrated condensate pump driven from an output shaft of said device.

167. The fluid energy-transfer device of claim 156 wherein said device is hermetically sealed.

168. The fluid energy-transfer device of claim 156 wherein said device is magnetically coupled with an external rotational shaft.

169. The fluid energy-transfer device of claim 156 further comprising a conduit for venting operating fluid from an internal housing cavity.

170. The fluid energy-transfer device of claim 169 wherein said operating fluid is vented to said outlet passage.

171. The fluid energy-transfer device of claim 169 with said conduit further comprising a pressure regulating valve.

172. The fluid energy-transfer device of claim 156 wherein said device is used as a compressor.

173. The fluid energy-transfer device of claim 172 wherein said inlet passage and said outlet passage of said end plate are configured for optimum compression of said fluid.

174. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said inner rotor having a coaxial hub extending normally from said inner rotor with said coaxial hub being mounted in said housing with a bearing assembly comprising a rolling element bearing, said bearing assembly:

(1) setting an axial position of said inner rotor; and
(2) maintaining a fixed-gap clearance of said second end of said inner rotor with said housing end plate at a substantially optimal distance as a function of bypass leakage and operating fluid shear forces.

175. The fluid energy-transfer device of claim 174 with said bearing assembly setting said rotational axis of said inner rotor.

176. The fluid energy-transfer device of claim 174 with said bearing assembly comprising a second rolling element bearing mounted in a pre-loaded configuration with said first rolling element bearing.

177. The fluid energy-transfer device of claim 176 with said bearing assembly setting said axial position of said inner rotor and a rotational axis of said inner rotor.

178. The fluid energy-transfer device of claim 174 wherein said device is used as a prime mover.

179. The fluid energy-transfer device of claim 178 wherein a pressurized operating fluid is used in said device to provide a motive force.

180. The fluid energy-transfer device of claim 179 wherein said inlet passage and said outlet passage of said end plate are configured for optimum expansion of said pressurized fluid in said device.

181. The fluid energy-transfer device of claim 179 wherein said pressurized fluid is in both a gaseous and a liquid state.

182. The fluid energy-transfer device of claim 179 wherein said pressurized fluid is in a gaseous state.

183. The fluid energy-transfer device of claim 178 further comprising an integrated condensate pump driven from an output shaft of said device.

184. The fluid energy-transfer device of claim 174 wherein said device is hermetically sealed.

185. The fluid energy-transfer device of claim 174 wherein said device is magnetically coupled with an external rotational shaft.

186. The fluid energy-transfer device of claim 174 further comprising a conduit for venting operating fluid from an internal housing cavity.

187. The fluid energy-transfer device of claim 186 wherein said operating fluid is vented to said outlet passage.

188. The fluid energy-transfer device of claim 186 with said conduit further comprising a pressure regulating valve.

189. The fluid energy-transfer device of claim 174 wherein said device is used as a compressor.

190. The fluid energy-transfer device of claim 189 wherein said inlet passage and said outlet passage of said end plate are configured for optimum compression of said fluid.

191. A rotary, chambered, fluid energy-transfer device comprising:

(a) a housing comprising:
(1) a housing cylindrical portion having a bore formed therein;
(2) a housing end plate having an inlet passage and an outlet passage;

(b) an outer rotor with a female gear profile rotating in said bore of said housing cylindrical portion and comprising:
(1) a radial portion;
(2) a female gear profile formed in said radial portion;
(3) a first end covering said female gear profile, and
(4) a second end skirting said female gear profile;

(c) an inner rotor with a male gear profile in operative engagement with said outer rotor; and (d) said inner rotor having a coaxial hub extending normally from said inner rotor with said coaxial hub being mounted in said housing with a bearing assembly comprising a first rolling element bearing and a second rolling element bearing mounted in a pre-loaded configuration, said bearing assembly:
1) setting at least one of:
a) a rotational axis of said inner rotor; and
b) an axial position of said inner rotor; and
2) maintaining a fixed-gap clearance of said inner rotor with at least one surface of
a) said housing; and
b) said outer rotor.

192. The fluid energy-transfer device of claim 191 wherein said fixed-gap clearance is a distance greater than the fluid boundary layer of an operating fluid used in said device.

193. The fluid energy-transfer device of claim 191 wherein said fixed-gap clearance is a substantially optimal distance as a function of bypass leakage and operating fluid shear forces.

194. The fluid energy-transfer device of claim 191 with said bearing assembly setting said rotational axis of said inner rotor.

195. The fluid energy-transfer device of claim 191 with said bearing assembly setting said axial position of said inner rotor.

196. The fluid energy-transfer device of claim 195 with said axial position of said inner rotor set so as to maintain a fixed-gap clearance of said first end of said inner rotor with an innerwall of said first end of said outer rotor at a substantially optimal distance as a function of bypass leakage and operating fluid shear forces.

197. The fluid energy-transfer device of claim 195 with said axial position of said inner rotor set so as to maintain a fixed-gap clearance of said second end of said inner rotor with said housing end plate at a substantially optimal distance as a function of bypass leakage and operating fluid shear forces.

198. The fluid energy-transfer device of claim 191 with said bearing assembly setting said axial position of said inner rotor and said rotational axis of said inner rotor.

199. The fluid energy-transfer device of claim 191 with said axial position of said inner rotor set so as to maintain a fixed-gap clearance of said first end of said inner rotor with an inner wall of said first end of said outer rotor at a substantially optimal distance as a function of bypass leakage and operating fluid shear forces.

200. The fluid energy-transfer device of claim 191 with said axial position of said inner rotor set so as to maintain a fixed-gap clearance of said second end of said inner rotor with said housing end plate at a substantially optimal distance as a function of bypass leakage and operating fluid shear forces.

201. The fluid energy-transfer device of claim 191 with said axial position of said inner rotor set so as to maintain said fixed-gap clearance:

a) of said first end of said inner rotor with an inner wall of said first end of said outer rotor, and b) of said second end of said inner rotor with said housing end plate at a substantially optimal distance as a function of bypass leakage and operating fluid shear forces.

202. The fluid energy-transfer device of claim 191 wherein said device is used as a prime mover.

203. The fluid energy-transfer device of claim 202 wherein a pressurized operating fluid is used in said device to provide a motive force.

204. The fluid energy-transfer device of claim 203 wherein said inlet passage and said outlet passage of said end plate are configured for optimum expansion of said pressurized fluid in said device.

205. The fluid energy-transfer device of claim 203 wherein said pressurized fluid is in both a gaseous and a liquid state.

206. The fluid energy-transfer device of claim 203 wherein said pressurized fluid is in a gaseous state.

207. The fluid energy-transfer device of claim 202 further comprising an integrated condensate pump driven from an output shaft of said device.

208. The fluid energy-transfer device of claim 191 wherein said device is hermetically sealed.

209. The fluid energy-transfer device of claim 191 wherein said device is magnetically coupled with an external rotational shaft.

210. The fluid energy-transfer device of claim 191 further comprising a conduit for venting operating fluid from an internal housing cavity.

211. The fluid energy-transfer device of claim 210 wherein said operating fluid is vented to said outlet passage.

212. The fluid energy-transfer device of claim 210 with said conduit further comprising a pressure regulating valve.

213. The fluid energy-transfer device of claim 191 wherein said device is used as a compressor.

214. The fluid energy-transfer device of claim 213 wherein said inlet passage and said outlet passage of said end plate are configured for optimum compression of said fluid.

215. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said outer rotor having a first coaxial hub extending normally from said outer rotor and mounted in said housing with a first bearing assembly comprising a first rolling element bearing and a second rolling element bearing mounted in a pre-loaded configuration;

(e) said inner rotor having a second coaxial hub extending normally from said inner rotor and mounted in said housing with a second bearing assembly comprising a first rolling element bearing:

(f) said first bearing assembly and said second bearing assembly:
  1) setting at least one of:
    a) a rotational axis of said inner rotor;
    b) a rotational axis of said outer rotor;
    c) an axial position of said inner rotor; and
    b) an axial position of said outer rotor; and
  2) maintaining a fixed-gap clearance of at least one of said inner rotor and said outer rotor with at least one surface of
    a) said housing; and
    b) said other rotor.

216. The fluid energy-transfer device of claim 215 wherein said fixed-gap clearance is a distance greater than the fluid boundary layer of an operating fluid used in said device.

217. The fluid energy-transfer device of claim 215 wherein said fixed-gap clearance is a substantially optimal distance as a function of bypass leakage and operating fluid shear forces.

218. The fluid energy-transfer device of claim 215 with said second bearing assembly comprising a second rolling element bearing mounted in a pre-loaded configuration with said first rolling element bearing of said second bearing assembly.

219. The fluid energy-transfer device of claim 218 with (a) said first bearing assembly setting said rotational axis of said outer rotor and said axial position of said outer rotor; and b) said second bearing assembly setting said rotational axis of said inner rotor and said axial position of said inner rotor.

220. The fluid energy-transfer device of claim 219 with said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device.

221. The fluid energy-transfer device of claim 219 with said axial position of said outer rotor set so as to maintain a fixed-gap clearance of said first end of said outer rotor with said housing at a distance greater than a fluid boundary layer of an operating fluid in said device.

222. The fluid energy-transfer device of claim 219 with said axial position of said outer rotor set so as to maintain a fixed-gap clearance of said second end of said outer rotor with said housing end plate at a substantially optimal distance as a function of bypass leakage and operating fluid shear forces.

223. The fluid energy-transfer device of claim 219 with said axial position of said inner rotor set so as to maintain a fixed-gap clearance of said first end of said inner rotor with an inner wall of said first end of said outer rotor at a substantially optimal distance as a function of bypass leakage and operating fluid shear forces.

224. The fluid energy-transfer device of claim 219 with said axial position of said inner rotor set so as to maintain a fixed-gap clearance of said second end of said inner rotor with said housing end plate at a substantially optimal distance as a function of bypass leakage and operating fluid shear forces.

225. The fluid energy-transfer device of claim 219 with:

a) said axial position of said inner rotor set so as to maintain said fixed-gap clearance of
  1) said first end of said inner rotor with an inner wall of said first end of said outer rotor; and
  2) said second end of said inner rotor with said housing end plate at a substantially optimal distance as a function of bypass leakage and operating fluid shear forces;

b) said rotational axis of said outer rotor set so as to maintain a fixed-gap clearance of a radial outer surface of said radial portion of said outer rotor with an inner radial surface of said housing cylindrical portion at a distance greater than a fluid boundary layer of an operating fluid in said device; and c) said axial position of said outer rotor set so as to maintain a fixed-gap clearance:
  1) of said first end of said outer rotor with said housing at a distance greater than a fluid boundary layer of an operating fluid in said device; and
  2) of said second end of said outer rotor with said housing end plate at a substantially optimal distance as a function of bypass leakage and operating fluid shear forces.

226. The fluid energy-transfer device of claim 215 wherein said device is used as a prime mover.

227. The fluid energy-transfer device of claim 226 wherein a pressurized operating fluid is used in said device to provide a motive force.

228. The fluid energy-transfer device of claim 227 wherein said inlet passage and said outlet passage of said end plate are configured for optimum expansion of said pressurized fluid in said device.

229. The fluid energy-transfer device of claim 227 wherein said pressurized fluid is in both a gaseous and a liquid state.

230. The fluid energy-transfer device of claim 227 wherein said pressurized fluid is in a gaseous state.

231. The fluid energy-transfer device of claim 226 further comprising an integrated condensate pump driven from an output shaft of said device.

232. The fluid energy-transfer device of claim 215 wherein said device is hermetically sealed.

233. The fluid energy-transfer device of claim 215 wherein said device is magnetically coupled with an external rotational shaft.

234. The fluid energy-transfer device of claim 215 further comprising a conduit for venting operating fluid from an internal housing cavity.

235. The fluid energy-transfer device of claim 234 wherein said operating fluid is vented to said outlet passage.

236. The fluid energy-transfer device of claim 234 with said conduit further comprising a pressure regulating valve.

237. The fluid energy-transfer device of claim 215 wherein said device is used as a compressor.

238. The fluid energy-transfer device of claim 237 wherein said inlet passage and said outlet passage of said end plate are configured for optimum compression of said fluid.

239. A rotary, chambered, fluid energy-transfer device comprising:

(a) a housing comprising:
  (1) a housing cylindrical portion having a bore formed therein;
  (2) a housing end plate having an inlet passage and an outlet passage;

(b) an outer rotor with a female gear profile rotating in said bore of said housing cylindrical portion and comprising:
  (1) a radial portion;
  (2) a female gear profile formed in said radial portion;
  (3) a first end covering said female gear profile, and
  (4) a second end skirting said female gear profile;

(c) an inner rotor with a male gear profile in operative engagement with said outer rotor; and (d) said outer rotor having a first coaxial hub extending normally from said outer rotor and mounted in said housing with a first bearing assembly comprising a first rolling element bearing;

(e) said inner rotor having a second coaxial hub extending normally from said inner rotor and mounted in said housing with a second bearing assembly comprising a first rolling element bearing and a second rolling element bearing mounted in a pre-loaded configuration with each other;

(f) said first bearing assembly and said second bearing assembly:
  1) setting at least one of:
    a) a rotational axis of said inner rotor;
    b) a rotational axis of said outer rotor;
    c) an axial position of said inner rotor; and
    b) an axial position of said outer rotor; and
  2) maintaining a fixed-gap clearance of at least one of said inner rotor and said outer rotor with at least one surface of
    a) said housing; and
    b) said other rotor.

240. The fluid energy-transfer device of claim 239 wherein said fixed-gap clearance is a distance greater than the fluid boundary layer of an operating fluid used in said device.

241. The fluid energy-transfer device of claim 239 wherein said fixed-gap clearance is a substantially optimal distance as a function of bypass leakage and operating fluid shear forces.

242. The fluid energy-transfer device of claim 239 wherein said device is used as a prime mover.

243. The fluid energy-transfer device of claim 242 wherein a pressurized operating fluid is used in said device to provide a motive force.

244. The fluid energy-transfer device of claim 243 wherein said inlet passage and said outlet passage of said end plate are configured for optimum expansion of said pressurized fluid in said device.

245. The fluid energy-transfer device of claim 243 wherein said pressurized fluid is in both a gaseous and a liquid state.

246. The fluid energy-transfer device of claim 243 wherein said pressurized fluid is in a gaseous state.

247. The fluid energy-transfer device of claim 242 further comprising an integrated condensate pump driven from an output shaft of said device.

248. The fluid energy-transfer device of claim 239 wherein said device is hermetically sealed.

249. The fluid energy-transfer device of claim 239 wherein said device is magnetically coupled with an external rotational shaft.

250. The fluid energy-transfer device of claim 239 further comprising a conduit for venting operating fluid from an internal housing cavity.

251. The fluid energy-transfer device of claim 250 wherein said operating fluid is vented to said outlet passage.

252. The fluid energy-transfer device of claim 250 with said conduit further comprising a pressure regulating valve.

253. The fluid energy-transfer device of claim 239 wherein said device is used as a compressor.

254. The fluid energy-transfer device of claim 253 wherein said inlet passage and said outlet passage of said end plate are configured for optimum compression of said fluid.

* * * * *

UNITED STATES PATENT AND TRADEMARK OFFICE

CERTIFICATE OF CORRECTION

PATENT NO. : 6,174,151 B1
DATED : January 16, 2001
INVENTOR(S) : Yarr

It is certified that error appears in the above-identified patent and that said Letters Patent is hereby corrected as shown below:

Column 10,
Line 27, delete "Pressures" and substitute therefor -- pressures --.

Column 21, claim 93,
Line 20, after the word "bore" delete the nummeral "18".

Column 23, claim 128,
Line 52, after the word "claim" delete the numeral "124" and substitute therefor the numeral -- 126 --.

Column 29, claim 215,
Line 58, before the word "an" delete "b)" and substitue therefor -- d) --.

Column 32, claim 239,
Line 9, before the word "an" delete "b)" and substitute therefor -- d) --.

Signed and Sealed this

Eighteenth Day of December, 2001

*Attest:*

*Attesting Officer*

JAMES E. ROGAN
*Director of the United States Patent and Trademark Office*